US009222310B2

(12) United States Patent
Peters

(10) Patent No.: US 9,222,310 B2
(45) Date of Patent: Dec. 29, 2015

(54) METHOD AND APPARATUS FOR LATERAL WELL DRILLING WITH ENHANCED CAPABILITY FOR CLEARING CUTTINGS AND OTHER PARTICLES

(75) Inventor: Jasper N. Peters, Millstadt, IL (US)

(73) Assignee: Latjet Systems LLC, Millstadt, IL (US)

( * ) Notice: Subject to any disclaimer, the term of this patent is extended or adjusted under 35 U.S.C. 154(b) by 1040 days.

(21) Appl. No.: 12/423,538

(22) Filed: Apr. 14, 2009

(65) Prior Publication Data

US 2009/0255732 A1 Oct. 15, 2009

Related U.S. Application Data

(60) Provisional application No. 61/044,552, filed on Apr. 14, 2008.

(51) Int. Cl.
*E21B 7/06* (2006.01)
*E21B 7/18* (2006.01)
*E21B 21/14* (2006.01)

(52) U.S. Cl.
CPC ..... *E21B 7/068* (2013.01); *E21B 7/061* (2013.01); *E21B 7/18* (2013.01); *E21B 21/14* (2013.01)

(58) Field of Classification Search
CPC ..... E21B 7/04; E21B 29/06; E21B 7/061
USPC ..... 175/54, 380, 62, 67, 77, 78, 424
See application file for complete search history.

(56) References Cited

U.S. PATENT DOCUMENTS

| | | | | |
|---|---|---|---|---|
| 2,271,005 | A * | 1/1942 | Grebe | 175/61 |
| 4,640,362 | A * | 2/1987 | Schellstede | 166/298 |
| 5,148,877 | A * | 9/1992 | MacGregor | 175/79 |
| 5,413,184 | A * | 5/1995 | Landers | 175/62 |
| 5,622,231 | A * | 4/1997 | Thompson | 175/77 |
| 6,283,230 | B1 * | 9/2001 | Peters | 175/67 |
| 7,455,127 | B2 * | 11/2008 | Schick | 175/61 |
| 7,699,107 | B2 * | 4/2010 | Butler et al. | 166/308.1 |
| 2009/0173544 | A1 * | 7/2009 | Peters | 175/62 |

* cited by examiner

*Primary Examiner* — Shane Bomar
*Assistant Examiner* — Elizabeth Gitlin
(74) *Attorney, Agent, or Firm* — Matthews Edwards LLC

(57) ABSTRACT

Apparatus for clearing particles from a lateral drilling operation in strata beside a well. The drilling apparatus is part of a down hole unit and is configured for extending from a lateral opening of the unit into a lateral passage in the adjacent strata, and the operation of the drilling apparatus discharges particles from the lateral passage toward the lateral opening. The invention deflects or redirects the particles discharged from the lateral passage, away from the lateral opening, to prevent clogging or blocking of an internal passage or elbow through the down hole unit, using a pressurized fluid such as a gas or an emulsion. The pressurized fluid can also be configured for carrying the particles upwardly through the well to the surface, and for reducing or removing a hydrostatic head in the well.

13 Claims, 25 Drawing Sheets

PRIOR ART

METHOD AND APPARATUS FOR LATERAL WELL DRILLING WITH ENHANCED CAPABILITY FOR CLEARING CUTTINGS AND OTHER PARTICLES

This application claims the benefit of U.S. Provisional Patent Application Ser. No. 61/044,552, filed Apr. 14, 2008.

TECHNICAL FIELD

This invention relates generally to methods and apparatus for penetrating a side of a well casing and/or drilling into earth strata beside or surrounding the well casing, or directly into the strata in the absence of a casing, and more particularly, to an improved method and apparatus for drilling into the casing and surrounding earth strata, which enhances the clearing of particles including cuttings and abrasives, if used, from the drilling, and reduces build up of the particles in and around the apparatus, for improved operation.

BACKGROUND ART

The disclosure of Peters U.S. Pat. No. 6,283,230 entitled METHOD AND APPARATUS FOR LATERAL WELL DRILLING UTILIZING A ROTATING NOZZLE, issued Sep. 4, 2001, as well as the disclosures of my co-pending U.S. patent application Ser. No. 12/350,707 and U.S. Provisional Patent Application Ser. Nos. 61/044,552 and 61/044,639, filed Apr. 14, 2008, are hereby incorporated herein by reference in their entireties.

A large number of wells have been drilled into earth strata for the extraction of oil, gas, and other material therefrom. In many cases, such wells are found to be initially unproductive, or decrease in productivity over time, even though it is believed that the surrounding strata still contains extractable oil, gas or other material. Such wells are typically vertically extending holes including a casing usually of mild steel pipe having an inner diameter of from just a few inches to about eight (8) inches or more in diameter for the transportation of the oil, gas or other material upwardly to the earth's surface.

In an attempt to obtain production from unproductive wells and increase production in under producing wells, as well as for improving production from wells generally, methods and apparatus for cutting a hole in the well casing and forming a lateral passage therefrom into the surrounding earth strata are known. Reference for instance, my previous Peters U.S. Pat. No. 6,283,230, which utilizes tubing having a free end including a nozzle through which fluid is discharged for drilling a lateral passage, which tubing and nozzle are advanced laterally from down hole apparatus, e.g., a kick-off shoe unit, into the lateral passage as the passage is increased in length. The kick-off shoe unit has an internal passage or elbow connecting with a laterally facing opening through which the tubing extends, and from which the tubing is advanced into and through a hole in the well casing and into the lateral passage in the formation. The tubing is also withdrawn from the lateral passage through the lateral opening and elbow of the kick-off shoe.

During the lateral drilling operation, whether using a rotating nozzle or stream as disclosed in my above-referenced patent, or other apparatus, cuttings and other particles will be generated and must be evacuated from the passage. If these remain in the passage, they can accumulate and build up, so as to impede or prevent movement of the cutting apparatus, which can include advancement, withdrawal, and/or rotational movements. Accumulated cuttings and other particles can also impede further movement and evacuation of the particles, and can even prevent removal of the drilling apparatus from the passage, so that forced extraction must be attempted or the lateral passage and down hole drilling apparatus abandoned, resulting in downtime and added cost. To avoid these problems, at least some of the fluid discharged from the nozzle or nozzles will be directed rearwardly through the drilled lateral passage so as to exit through the connecting hole in the casing, for carrying at least a substantial portion of the cuttings and other particles from the passage. The pressure and force of the exiting fluid can vary, for a variety of reasons, including the level of the hydrostatic pressure in the well, the composition of the formation and ability to absorb fluid, and the pressure and volume of the fluid discharged from the nozzle. In any event, the fluid pressure should always be sufficient for drilling satisfactorily, and for carrying the particles and other cuttings from the lateral passage to avoid the above problems.

On the one hand, it is desirable for the fluid and cuttings to be ejected forcefully from the lateral passage and into the well, so as not to accumulate and lodge in the lateral passage, and this is facilitated by decreasing the hydrostatic pressure in the well, as disclosed in my earlier patent. But, on the other hand, when the fluid is discharged forcefully from the lateral passage, the cuttings can in turn be forced into the opposing laterally facing opening of the down hole apparatus, including into the elbow of the kick-off shoe. This creates a resulting problem of the cuttings and other particles interfering with the movement of the drill apparatus, e.g., my flexible tubing, in the shoe, namely, impeding the rotation and/or advancement and/or withdrawal of the tubing through the shoe, so as to correspondingly do the same in the lateral passage. Cutting and other particles can also enter the elbow of the kick-off shoe when drilling through the casing, and cause problems with operation and movement of that drilling apparatus also, whether a liquid jet or mechanical cutter is used.

A laterally opening of the kick-off shoe will be beside and in opposing relation to the inner surface of the well casing and the hole therein, or the hole in the strata if the lateral passage is formed in an uncased region of the well, such that an interface exists or is defined between the opening and the hole. This interface will typically comprise a relatively small space or gap, on the order of less than 1 to 2 inches, but could also be an abutting relationship. Alternatively, if the lateral passage is formed in a larger uncased region of the well, for instance, in an under-reamed region of the well, below the casing, the interface may be substantial in size, e.g., greater than 2 inches. The drilling apparatus, e.g., the flexible tube or hose and nozzle, will extend and move through this interface. The cuttings are also desirably discharged or ejected from the lateral passage into this interface and so as to be carried away from the laterally facing opening of the shoe, but, in practice, because of the pressure of the carrying fluid, this will often not occur, particularly if the interface is smaller, resulting in cuttings and other particle build-up in the elbow of the shoe and resultant problems as discussed above.

Accordingly, what is sought is a solution to build up of cuttings and other particles in the kick-off shoe unit or other down-hole lateral drilling apparatus, for overcoming one or more of the resultant problems and shortcomings set forth above.

DISCLOSURE OF THE INVENTION

What is disclosed is apparatus and a method for clearing cuttings and other particles resulting from a lateral drilling operation, for reducing build-up in adjacent apparatus, and which overcomes one or more of the problems and shortcomings set forth above, and which can be used in connection with drilling through the casing and/or the formation.

Generally, the lateral drilling apparatus with which the invention will be used will typically include a kick-off shoe unit or other device or apparatus positionable in the well at the depth of the lateral passage, for guiding drilling apparatus, e.g., casing cutter or drill, flexible tube with nozzle on the end, against the well casing (if present) and into the formation or strata beyond the casing, or directly into the formation if the casing is not present at the location of the lateral passage. The kick-off shoe unit will include an elbow therein which extends downwardly from an upper opening and turns in a lateral direction to a lateral opening, and through which the drilling apparatus will be supported and guided against the casing (if present), and, when through the casing, and, or if no casing is present, against and into the formation for drilling the lateral passage. The drilling apparatus will be advanced through the elbow of the kick-off shoe as the drilling operation progresses, and will be withdrawn in the opposite direction from the lateral passage. To facilitate this, the lateral hole in the casing, or directly in the formation, and the lateral opening of the shoe connecting with the elbow, will be aligned, and will form an interface therebetween, which will either comprise a space or an abutting relation. This interface will comprise a portion of what is commonly referred to as the "annulus" between the inner surface of the casing or formation and the outer surface of the down hole apparatus, in this instance, the shoe.

The drilling apparatus can include, but is not limited to, a rotatable casing cutter (if cutting through the casing is required) which can be, for instance, a carbide bit, for drilling or cutting through the casing, and a separate fluid nozzle on a flexible tube for drilling the lateral passage in the formation, or, it can include just a nozzle if the fluid medium is capable of penetrating the casing, which fluid medium can also optionally carry suitable abrasives, if required. The nozzle can be rotating or non-rotating, and will preferably produce one or more pressurized fluid streams that will impinge the opposing formation in a suitable manner for instance, in a rotating manner, for cutting or drilling the lateral passage through it.

In operation, as the casing is being cut, particles including cuttings will be generated. And, as the lateral passage in the formation is drilled or formed, at least a portion of the pressurized fluid discharged from the nozzle or nozzles will exit the drilled lateral passage through the connecting hole in the casing, in the well known manner, and will carry at least a substantial portion of the cuttings and other particles from the passage. In both instances, it will be desirable to avoid entry of the cuttings and other particles into the lateral opening of the shoe, or other down hole apparatus, to avoid the problems set forth above. However, in the latter instance at least, the pressure and forcefulness of the fluid, cuttings and other particles exiting the lateral passage can be relatively great, making it difficult to avoid entry thereof into the lateral opening. Additionally, as the down hole apparatus is lowered into a well, and at other times when in the well, it may be subject to entry and accumulation of particulates and other solid matter that may be present in the well, so as to possibly result in blockage or clogging of internal passages within the apparatus, in the principal example discussed above, the lateral opening and elbow of the kick-off shoe.

According to a preferred aspect of the invention, cuttings and other particulates and solids are directed away from the lateral opening of the down hole apparatus or shoe, and, optionally other openings, using at least one pressurized stream or flow of a gas or an emulsion of a gas and other material, such as a soap or drilling foam. The stream or flow of the gas or emulsion can be directed in any suitable direction for carrying the cuttings away, but it is most preferred to direct or carry the cuttings upwardly, and from the well, in the manner disclosed in my prior patent for removing liquid from the well for reducing the hydrostatic head therein. In this way, the cuttings and/or other particles or solids, will only minimally collect in the openings and passages of the down hole apparatus and the bottom of the well, and will be easier to remove.

According to a preferred embodiment of the invention, the pressurized gas or emulsion is delivered through the elbow of the kick-off shoe, or another suitable passage or passages therethrough, to the lateral opening and/or an outlet in the vicinity thereof, and will be directed in a manner so as to carry or direct the cuttings and/or other particulates or solids away from the lateral opening. The exterior of the kick-off shoe can be configured for facilitating this, for instance, by providing at least one relief or channel emanating from the lateral opening, and through which the gas or emulsion containing cuttings and/or other particles or solids can be directed away from the opening. A preferred embodiment of this relief or channel will extend upwardly from the lateral opening. This is particularly desirable when the interface between the hole in the casing or formation, and lateral opening of the shoe, is small or an abutment. The size of the relief or channel will be selected for best particle and cuttings flow.

As an example, a stream of the pressurized gas or emulsion may be directed outwardly from the lateral opening of the shoe, and also from a discharge outlet just above the lateral opening, so as to boost and/or accelerate the upward flow and evacuation of the particles and cuttings from the region around the lateral opening. The pressure of the gas or emulsion exiting the opening and the outlet or outlets can be the same, or different, as desired or required for sufficiently evacuating the particles in a desired manner. The pressurized gas can include, but is not limited to, air, carbon dioxide, nitrogen, a mixture of these, and/or other inert gas, and, as noted above, the emulsion can include, but is not limited to, any of these gases or combinations of gases, and a well-known, commercially available soap, drilling foam, or foaming agent. The pressurized gas or emulsion will also preferably be sufficient in quantity and character for carrying the particles and cuttings to the surface of the well, and can be suitably pressurized, such as by using a well-known, commercially available gas compressor.

According to another aspect of the invention, the outlet or outlets will be connected with an internal passage or passages through the kick-off shoe, although external conduits such as, but not limited to, tubing, or the like, can be used. The soap, foam, or foaming agent, if used, can be added to the flow in a well-known, commercially available manner, such as utilizing a pump on the surface, for pumping it into the flow of compressed gas in a desired proportional amount, and may include a small proportion of a liquid, such as water to facilitate the emulsification. The pressurized gas or emulsion will be communicated down hole via tubing, piping or other suitable conduit. According to a preferred aspect of the invention, the compressed gas such as air will be communicated down hole at sufficient pressure and in sufficient quantity for reducing the hydrostatic head by a desired amount, and for removing the cuttings from the well. The compressed gas will be carried by a length of outer tubing suspended in the well and supporting the kick-off unit, including the kick-off shoe or other down hole drilling apparatus.

An inner length of tubing will be located within the outer tubing and will carry other pressurized fluid (e.g., liquid) for communication to the nozzle (and drill motor if used) of the drilling apparatus. The pressurized gas (e.g., air) in the outer tubing, instead of, or in addition to, being jetted out from the tubing at some elevation above the shoe and lateral passage as taught in my earlier patent, will be directed into the shoe, and more particularly, into the elbow. In regard to the combination of directing this flow through both jets above the shoe and through the elbow of the shoe, it is contemplated that the jetted flow will be regulated down, such that the bulk of the flow will be through the elbow, but not such that cuttings and other particle evacuation from the drilling operation is impeded. Direction of the flow to the elbow of the kick-off shoe is preferably achieved via a sheath suspended from suitable apparatus such as a drill unit disposed down hole within the outer tubing, and the lower end of which sheath is in abutting relation with a beveled edge within the kick-off shoe at the upper end of the elbow as also disclosed in my earlier patent. Here though, the sheath is modified to connect the interior of the outer tubing with the interior of the sheath, for instance, by providing one or more holes through the sheath.

Thus, according to the invention, a pathway is provided for the pressurized gas or emulsion, from a compressor or pump on the surface, down through the well through the interior of the outer tubing, and through the hole or holes in the sheath and into the elbow of the kick-off shoe, where the fluid will exit in the above described manner, for clearing cuttings and other particles from the vicinity of the lateral opening of the shoe, and for preventing entry thereof into the opening so as to interfere with movement of the flexible tubing therein. The sectional size of the elbow will be sufficient for accommodating the flexible tubing and also the pressurized gas or emulsion.

As noted above, the pressurized gas, e.g., compressed air, or emulsion, exiting the shoe can be used for clearing cuttings from the vicinity of the lateral opening, and also for reducing the hydrostatic head, in this latter regard, either alone, or in combination with other elements for that purpose. In my prior patent, the lower end of the outer tubing is configured as a jet tube, including one or more air jets for discharging pressurized air carried in the outer tubing, into the well, which air will then rise and carry liquid present in the lower portion of the well casing upwardly to the surface. In the present invention, this is at least mostly replaced by discharging of the pressurized gas or emulsion from the region around the lateral opening of the shoe, and/or discharge from the lateral opening itself. Supplemental arrangements for discharge of pressurized gas, e.g., air, or emulsion, can also be utilized, as desired or required. For example, outlets or nozzles can be provided at intervals along the length of a selected portion of the outer tubing, for discharging pressurized gas or emulsion therefrom, for boosting the upward flow of the cuttings and other particles, particularly abrasives, and liquid through the well. Such additional outlets or nozzles can also facilitate the upward flow of the liquid and cuttings and other particles within the well when the hydrostatic head is sufficiently great to prevent discharge of the gas or emulsion, e.g., air, through the lateral opening and related outlets. Further in this regard, by discharging some of the pressurized gas or emulsion at higher regions within a well, the pressure of the gas or emulsion in and discharged from the lower region, e.g., the lateral opening of the kick-off shoe, will be at a lower pressure. This can be an advantage, as prior to initiation of the introduction of the pressurized gas or emulsion, the hydrostatic head will be present within the outer tubing of the down-hole apparatus. Then, as the pressurized gas or emulsion is introduced into this tubing, the liquid therein will be displaced to the annulus between the inner surface of the well casing and the outer surface of this tubing, so as to increase the height of the column of liquid in the annulus, thereby making it harder to lift to the surface. By providing additional outlets or nozzles at one or more higher elevations within the well, the pressurized gas or emulsion introduced into the annulus will be better able to lift the liquid at that level or levels for reducing the hydrostatic head, and importantly, the required pressure in the vicinity of the kick-off shoe for removing the hydrostatic head from that location. The ability to have a lower pressure at the lower region within the well is advantageous particularly in wells containing fine particulates, such as, but not limited to, coal bed methane, as it reduces the occurrence or possibility of those particulates being forced into the formation by a higher pressure. This is also advantageous if the well produces a large amount of liquid or the apparatus has been idle for a sufficient time for a tall hydrostatic head to form, particularly if so large that not enough pressure can be developed by the compressor apparatus for removing the head from the region of the kick-off shoe alone.

BEST MODE FOR CARRYING OUT THE INVENTION

Figure 1:
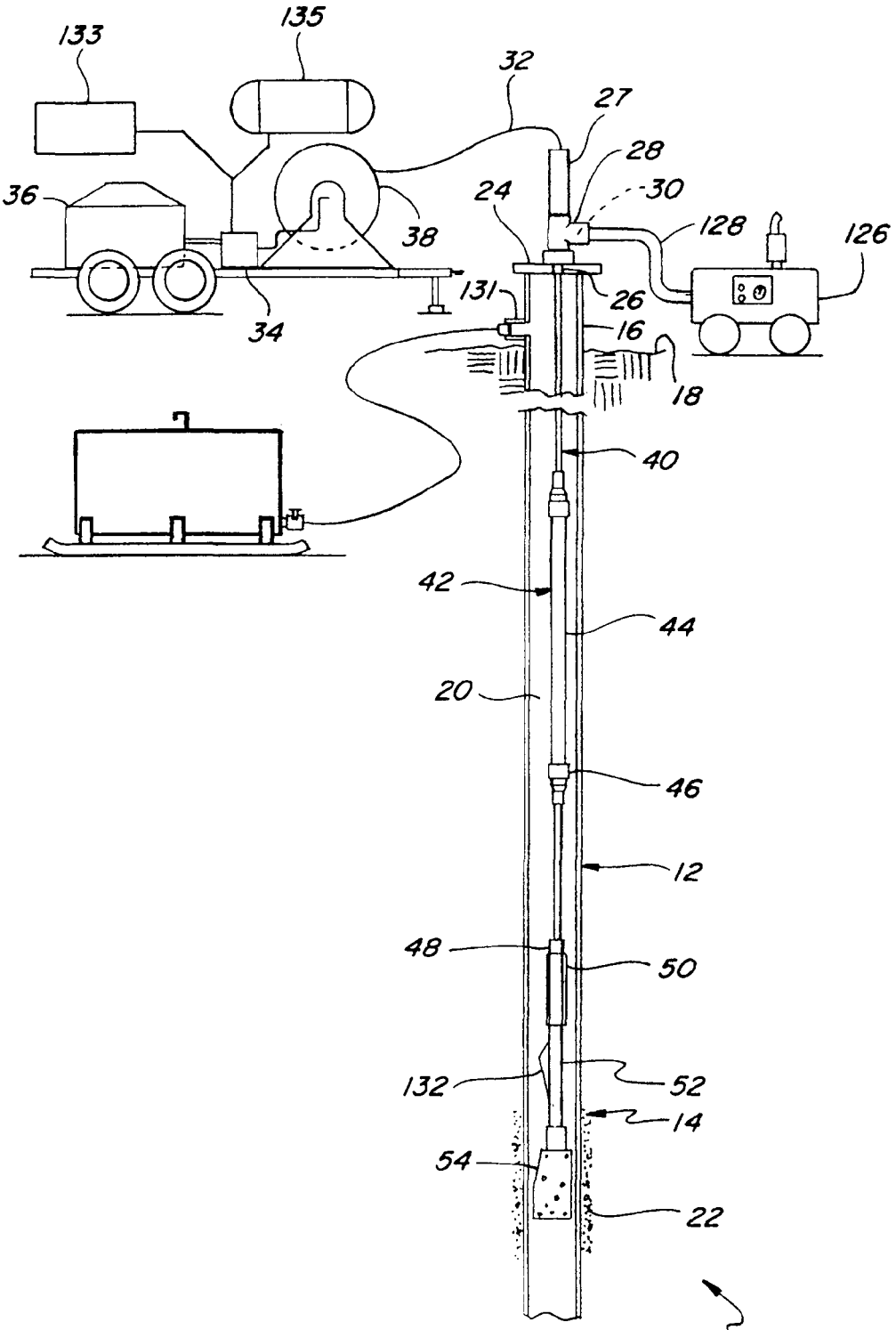
Fig. 1 PRIOR ART
FIG. 1 is a side elevational view showing a well in fragmentary cross section and apparatus according to my prior invention therein in position for penetrating the well casing thereof.
Figure 2:
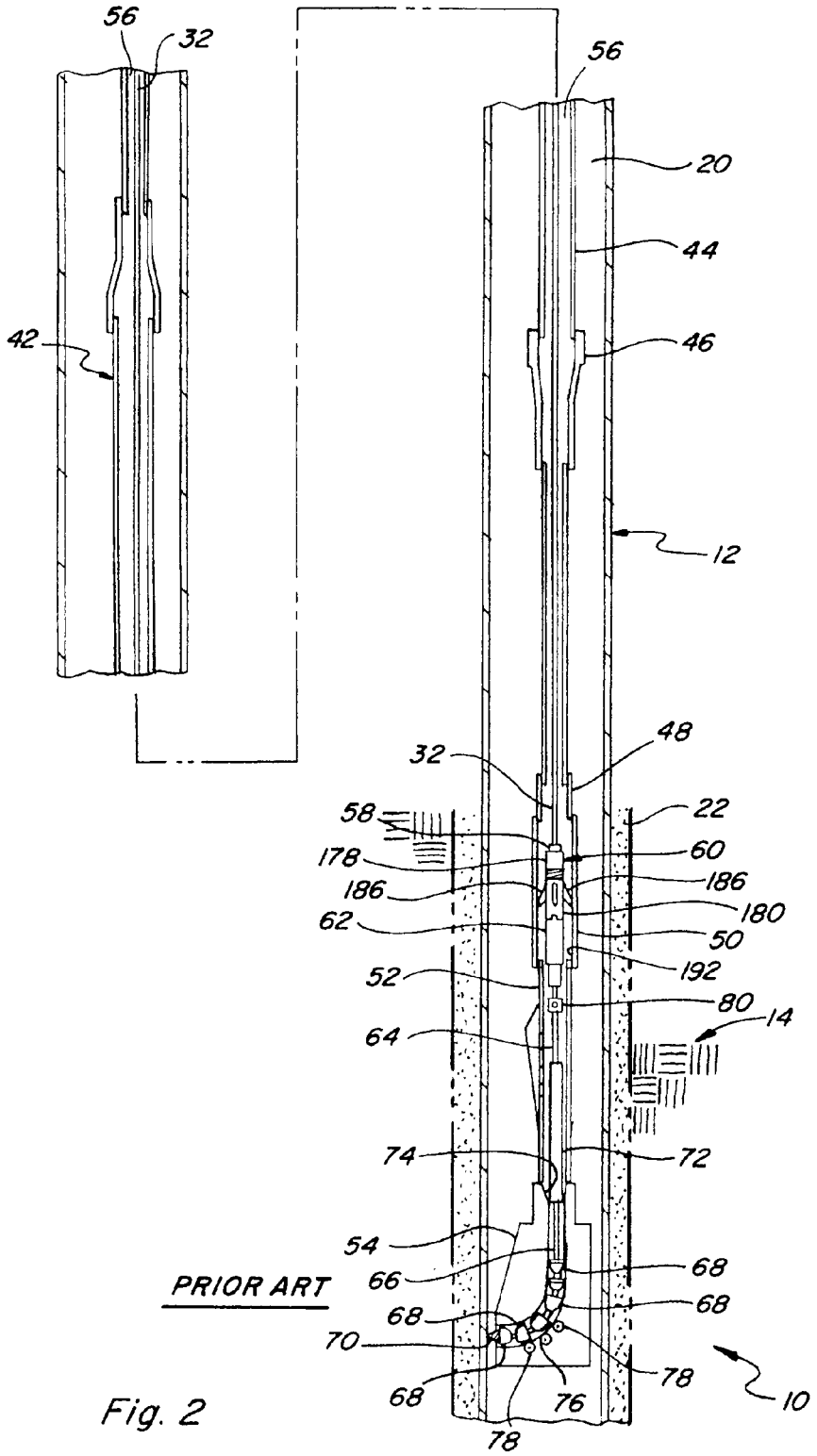
FIG. 2 is a side elevational view of the well and apparatus of FIG. 1 in partial cross-section showing the apparatus being used to form a hole through the casing.

FIGS. 1 and 2 show apparatus 10 constructed and operable according to my previous invention of Peters U.S. Pat. No. 6,283,230, for penetrating a well casing 12 and surrounding earth strata 14. As explained in that patent, well casing 12 consists of steel piping extending from a well head 16 on or near the earth's surface 18 downwardly through strata 14 into a formation therein which hopefully contains oil and/or gas. Well casing 12 is of conventional construction defining an interior cavity or passage 20 of from between about 4 to about 8 inches in diameter and from several hundred to several thousand feet in depth. Cement or other material 22 is typically located around well casing 12 to hold it in place and prevent leakage from the well. Well head 16 includes a cap 24 having an opening 26 therethrough communicating passage 20 with a conventional oil saver device 27, and a tee 28 including an access port 30.

Apparatus 10 includes a quantity of flexible tubing 32 adapted for holding fluid under pressure sufficient for drilling the formation, and additionally casing 12, if apparatus 10 is appropriately configured to provide a casing cutting capability, e.g., using abrasives delivered against the casing via a nozzle. As non-limiting representative operating pressures, pressure of as high as about 10,000 psi have been used for wells at depths of about 2000 feet from the surface, and higher pressures such as about 15,000 psi can be used for drilling at greater depths. The fluid under pressure is supplied by a pump 34 connected to a fluid source 36 such as a city water supply, a water tank or the like. Flexible tubing 32 is stored on a reel 38 from which the tubing is fed into a length of more rigid tubing 40 which extends a desired distance down through interior passage 20 of casing 12 to a desired elevation below the earth's surface. Tubing 40 terminates in passage 20 of casing 12 at a coupling with a down hole unit 42 suspended in passage 20 by tubing 40. According to one embodiment with which the present invention can be used, down hole unit 42 includes a tubular motor housing 44, an upper receiving tube 46 and a kick-off shoe unit 48. Kick-off shoe unit 48 is shown including a tubular casing drill receiving unit 50, an air jet tube 52 and a bottom-most kick-off shoe 54. Tubing 40 and down hole unit 42, including motor housing 44, upper receiving tube 46, and all of the above discussed components of kick-off shoe unit 48 remain in the position shown down hole in casing 12 throughout operation of apparatus 10.

Flexible tubing 32 extends through a cavity 56 extending through tubing 40 and down hole unit 42, and terminates at a coupler 58 shown supporting a casing drill unit 60 in FIG. 2. Casing drill unit 60 includes a fluid driven motor 62 connected in fluid communication with flexible tubing 32. Motor 62 is constructed essentially as shown in FIG. 9A, and in the configuration shown in FIG. 2, is connected to an output shaft 64 operatively rotatable thereby and including a terminal end 66 supporting a plurality of universal joints 68 for rotation therewith, including an end most universal joint 68 having a conical shaped casing cutter 70 mounted thereto for rotation therewith. As an alternative to using a casing cutter such as cutter 70, the apparatus of the invention can use an abrasive stream for penetrating casing 12. A protective sheath 72 is also mounted about output shaft 64 and defines an inner cavity (not shown) for containing and protecting universal joints 68 and casing cutter 70 as those members are lowered through cavity 56 of tubing 40 and down hole unit 42. Sheath 72 will be modified as taught by my present invention, as will be explained below. As casing drill unit 60 is lowered through cavity 56, sheath 72 will come into abutting relation with a beveled edge 74 within kick-off shoe 54 thus stopping downward travel of the sheath, while casing cutter 70 and universal joints 68 will proceed into shoe 54, travel around an elbow 76 therein, such that casing cutter 70 will come as shown to rest against the inner surface of casing 12. In this regard, shoe 54 includes a plurality of rollers 78 to facilitate travel of cutter 70 and universal joints 68 through elbow 76, and output shaft 64 includes a swivel 80 for alignment purposes. Here, for the purposes of the present invention, it will be preferred that the end of sheath 72 and beveled edge form at least a substantially sealed condition suitable for conveying pressurized fluid between the sheath and shoe 54, as will be explained.

Figures 2A, 2B:
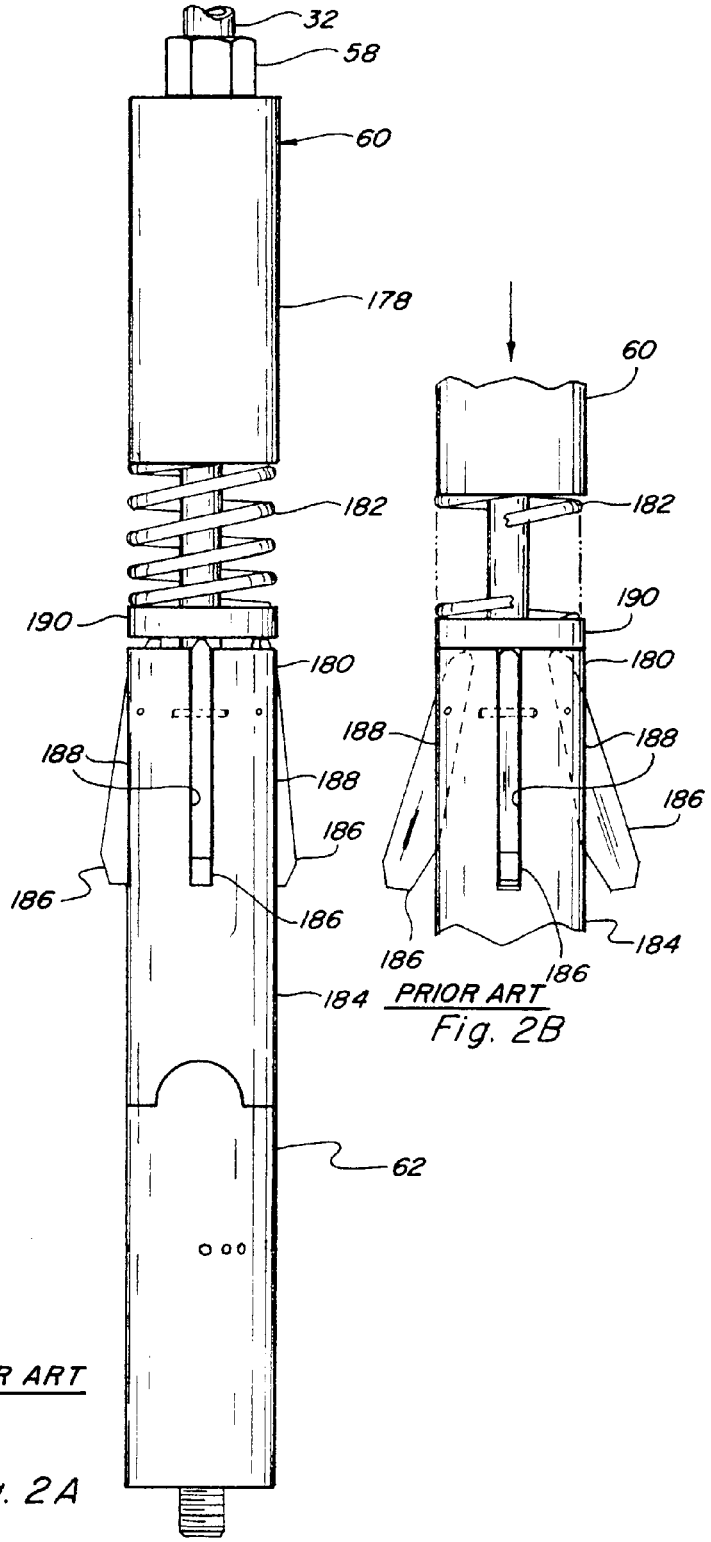
Fig. 2A PRIOR ART
FIG. 2A is a fragmentary enlarged fragmentary side view of the apparatus of FIG. 1.
FIG. 2B is another enlarged fragmentary side view of the apparatus of FIG. 1.

Also referring to FIGS. 2A and 2B, casing drill unit 60 of my prior invention additionally includes an upper portion 178 connected to flexible tubing 32 via coupler 58, and a spring loaded dog assembly 180 disposed between upper portion 178 and motor 62. Dog assembly 180 includes a compression coil spring 182 disposed between upper portion 178 and a dog housing 184 including a plurality of dogs 186 pivotally mounted in slots 188 at angularly spaced locations around housing 184. Dogs 186 are maintained in engagement with a spring retainer 190 by spring 182 in a retracted position (FIG. 2A) and are moveable in opposition to the spring to a radially extended position (FIG. 2B). When radially extended, dogs 186 engage a splined inner circumferential surface 192 of casing drill receiving unit 50 for preventing rotating of casing drill unit 60 therein. Then, as one alternative, after the casing drilling operation is completed as explained next, and casing drill unit 60 is withdrawn from receiving unit 50, dogs 186 retract to allow passage upwardly through the upper portion of down hole unit 42 and tubing 40.

Figure 3:
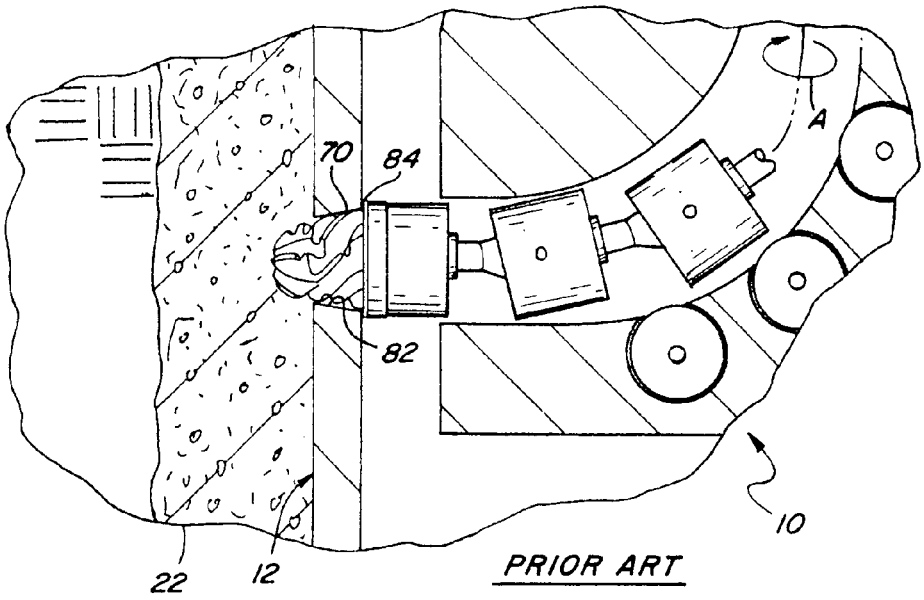
FIG. 3 is an enlarged fragmentary sectional view of the well and apparatus of FIG. 1 showing the completed hole through the casing.

Referring also to FIG. 3, rotation of casing cutter 70 of apparatus 10 as shown by arrow A, by motor 62 while urged against the inner surface of casing 12 results in casing cutter 70 cutting through casing 12, producing a hole 82. Desirably, an annular drill stop 84 extends around casing cutter 70 at a predetermined location spaced from the tip thereof to prevent casing cutter 70 from cutting substantially past casing 12 into cement 22. Upon formation of hole 82, operation with casing drill unit 60 is complete, and that unit can be withdrawn from down hole unit 42 and tubing 40.

Figure 3A:
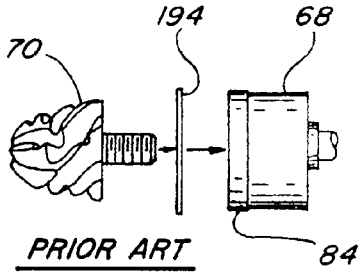
FIG. 3A is an exploded side view of a cutter of the apparatus of FIG. 1.

Referring to FIG. 3A, a consumable shim 194 is disposed between cutter 70 and drill stop 84 which is mounted to endmost universal joint 68. Shim 194 is damaged by rotating contact with the inner surface of casing 12 and importantly can be inspected after withdrawal of unit 60 from casing 12 for verify that hole 82 has been properly formed.

Figure 4:
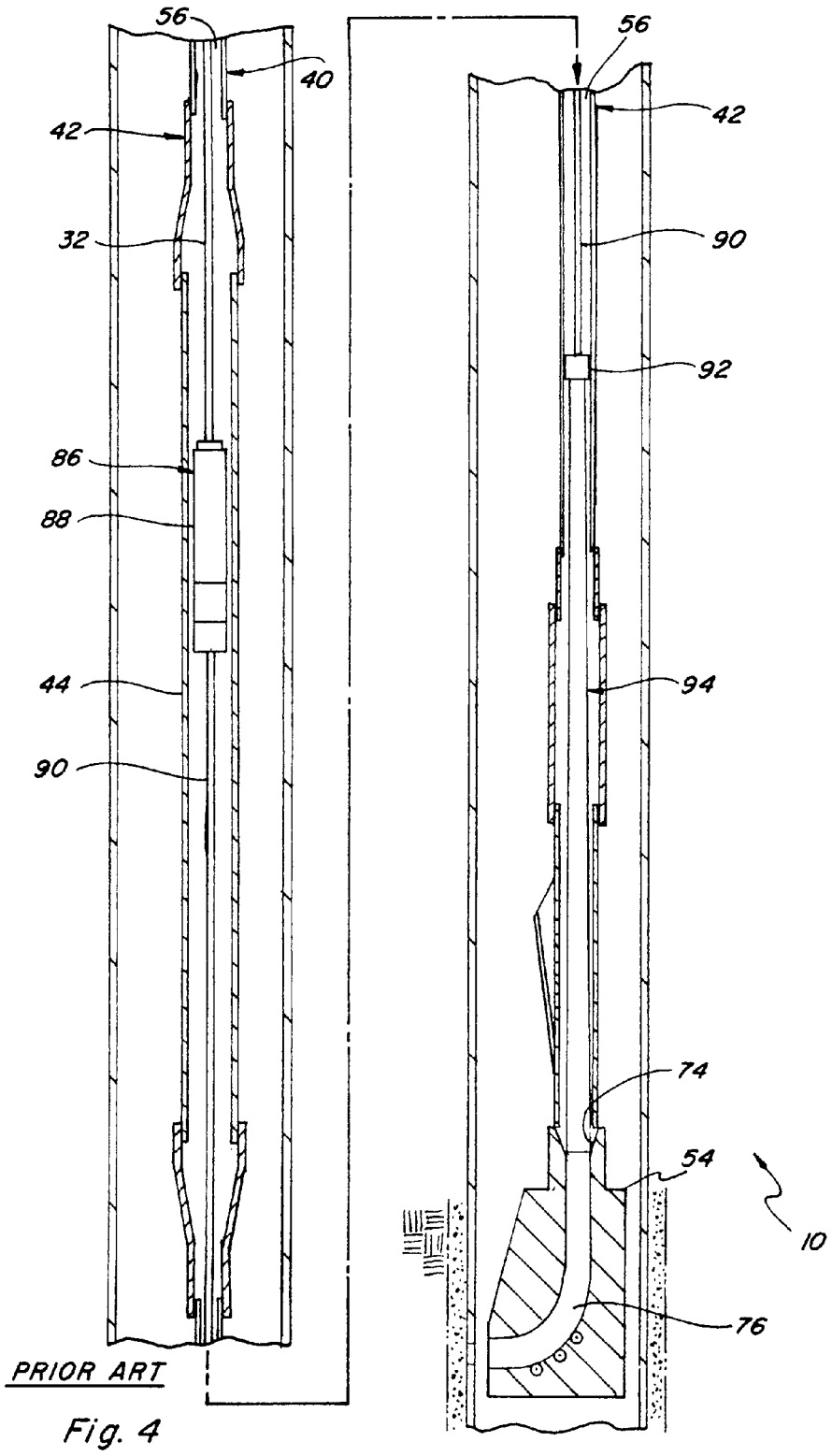
FIG. 4 is a fragmentary side elevational view in section showing apparatus according to my prior invention for drilling strata surrounding the well casing.

Referring to FIG. 4, after withdrawal of casing drill unit 60, a strata drill unit 86 of apparatus 10 is mounted to flexible tubing 32 and lowered through cavity 56 of tubing 40 and down hole unit 42 to kick-off shoe 54. Strata drill unit 86 includes a fluid driven motor 88 located in motor housing 44, motor housing 44 having an inside cross-sectional shape at least marginally larger than the outer cross-sectional shape of motor 88, as will be discussed. A rigid tube 90 is connected to motor 88 for rotation thereby. Rigid tube 90 terminates at an upper end 92 of a set down device 94.

Figure 5:
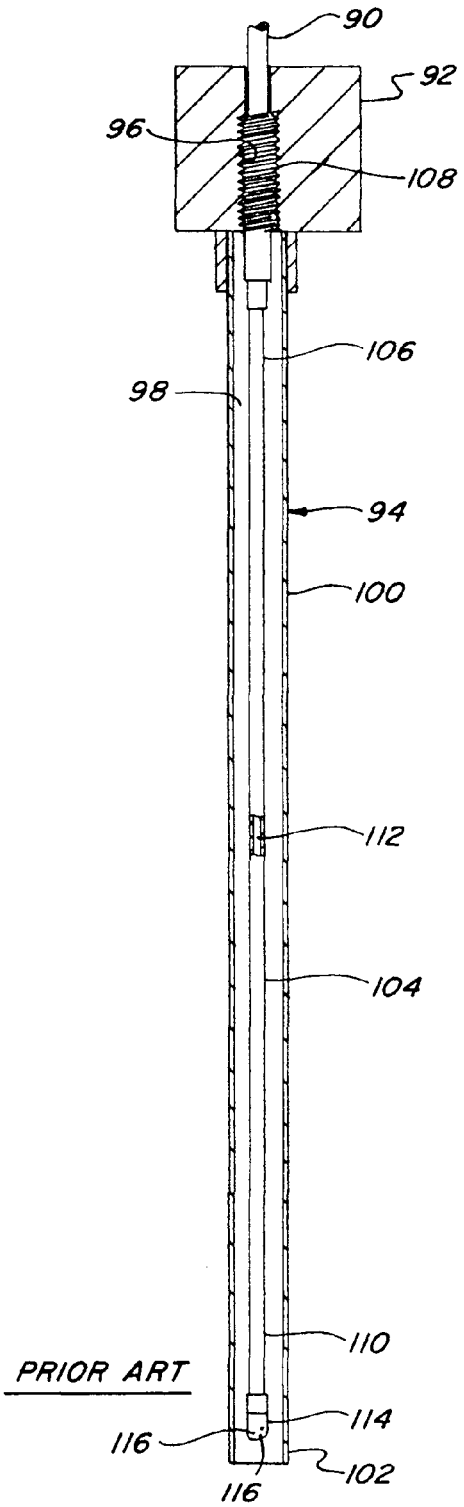
FIG. 5 is a fragmentary side view in partial cross-section of the apparatus of FIG. 4.
Figure 5A:
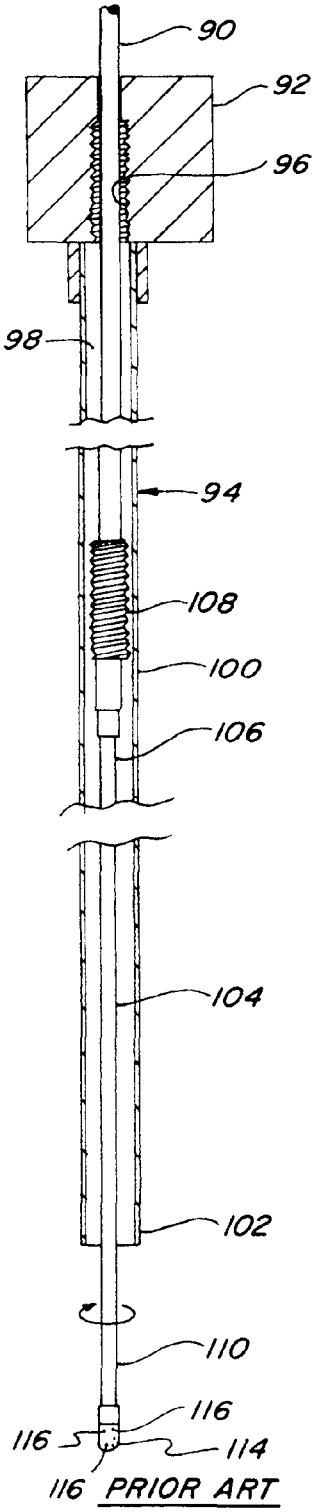
FIG. 5A is a fragmentary side view of the apparatus of FIG. 4 in an extended position.

Referring also to FIGS. 5 and 5A, set down device 94 includes a threaded passage 96 extending therethrough and communicating with an internal passage 98 of a rigid tubular sheath 100. Sheath 100 includes a bottom most terminal end 102 positionable in abutment with beveled edge 74 of kick-off shoe 54 for positioning internal passage 98 in communication with elbow 76 (FIG. 4). A flexible tube 104 has an upper end 106 mounted to rigid tube 90 for rotation therewith by an externally threaded coupler 108 adapted for threaded engagement with set down device 94 in threaded passage 96. When coupler 108 is threadedly engaged with set down device 94, flexible tube 104 is located and protected within internal passage 98 of sheath 100. Flexible tube 104 includes a lower end 110 opposite upper end 106, and an internal passage 112 therethrough connecting upper end 106 with lower end 110. A nozzle 114 is mounted to lower end 110 of tube 104 in fluid communication with internal passage 112. Nozzle 114 includes a plurality of apertures 116 therethrough.

Referring more particularly to FIGS. 4, 5 and 5A, motor 88 is operable to rotate rigid tube 90 to threadedly disengage coupler 108 from threaded passage 96 of set down device 94 to allow nozzle 114 and lower end 110 of flexible tube 104 to drop beneath sheath 100, for entering elbow 76 of shoe 54.

Figure 6:
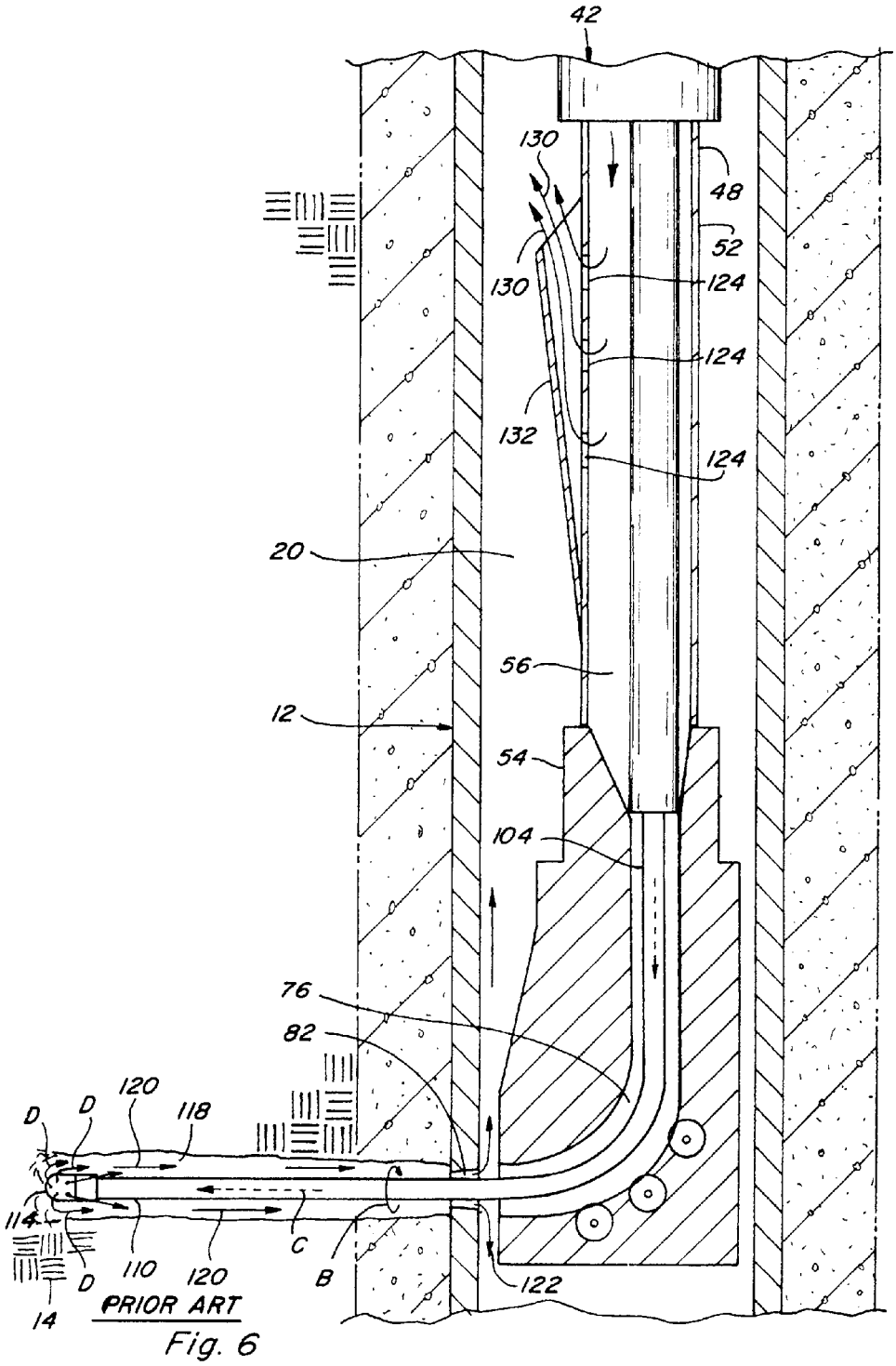
FIG. 6 is a fragmentary side elevational view of the apparatus of FIG. 4 drilling an extension of the hole of FIG. 2 into the strata and reducing a hydrostatic head over the hole.

Turning to FIG. 6 as flexible tube 104 is continually lowered, lower end 110 and nozzle 114 will pass through elbow 76 of shoe 54 and into hole 82 through casing 12, hole 82 having a slightly tapered shape corresponding to the shape of casing cutter 70. As nozzle 114 advances through hole 82, it is rotated as denoted by the arrow B by motor 88 (FIG. 4) and fluid from fluid source 36 is pressurized by pump 34 (FIG. 1) and communicated to nozzle 114 through motor 88, rigid tube 90 (FIG. 4), and flexible tube 104, as denoted by the arrow C. The fluid under pressure is discharged from nozzle 114 through apertures 116 against cement and strata 14 lying beyond hole 82, as denoted by the arrows D. The fluid under pressure impinging the cement and/or strata 14, in combination with the rotation of nozzle 114, operates to loosen and dislodge particles, also referred to herein as cuttings, to thereby drill an extension 118 of hole 82 into the cement and/or strata 14. Additionally, a fluid flow as shown by the arrows 120 is created by the discharged fluid for carrying the particles through extension 118 and hole 82 so as to be discharged into interior passage 20 of casing 12 as denoted by arrow 122.

During the strata drilling step, it has been found that if a hydrostatic head having a pressure greater than the formation pressure in extension 118 is present above the drilling location, for instance, resultant from the addition of water or liquid from the strata drilling operation to the column of liquid normally present in casing 12, liquid will be absorbed into the formation or strata around nozzle 114 and flexible tube 104, so as to stop the fluid and particle flow denoted by arrows 120. For instance, it has been found when attempting to drill an extension 118 at a depth of about 2500 feet below the earth's surface and with a hydrostatic head which has greater head pressure than the formation pressure, little to no drilling progress could be made, which is believed largely due to limitations on particle and fluid flow 120 caused by the hydrostatic head.

To mitigate the above discussed problems relating to a large hydrostatic head, my prior invention utilized an air jet tube 52 having a plurality of air jets 124 communicating internal passage 56 extending through tubing 40 and down hole unit 42 with interior passage 20 of casing 12. An important purpose for discharging air under pressure into interior passage 20 is to use the air as a vehicle for transporting water and other liquids in interior passage 20 upwardly through the passage so as to be discharged through an access port 131 at the earth surface 18, or through some other convenient port at the surface, to effectively reduce any hydrostatic head that may be present.

Here, it should be noted that periodically during the strata drilling step, air or gas under pressure can be injected into flexible tubing 32 so as to be discharged through apertures 116 of nozzle 114, for clearing any debris or blockage that may be present therein and for clearing accumulated debris from extension 118. A suitable pressure for the air or gas has been found to be about 2,000 psi or greater, and it can be injected by a high pressure compressor 133 or other suitable device connected to tubing 32 at pump 34 as shown or at another suitable location. This is believed to be effective because with the reduction of the hydrostatic head in the well, when the air or gas under pressure exits apertures 116 the air or gas will expand and move at high velocity toward casing 12 to urge the cuttings from extension 118.

Figure 7:
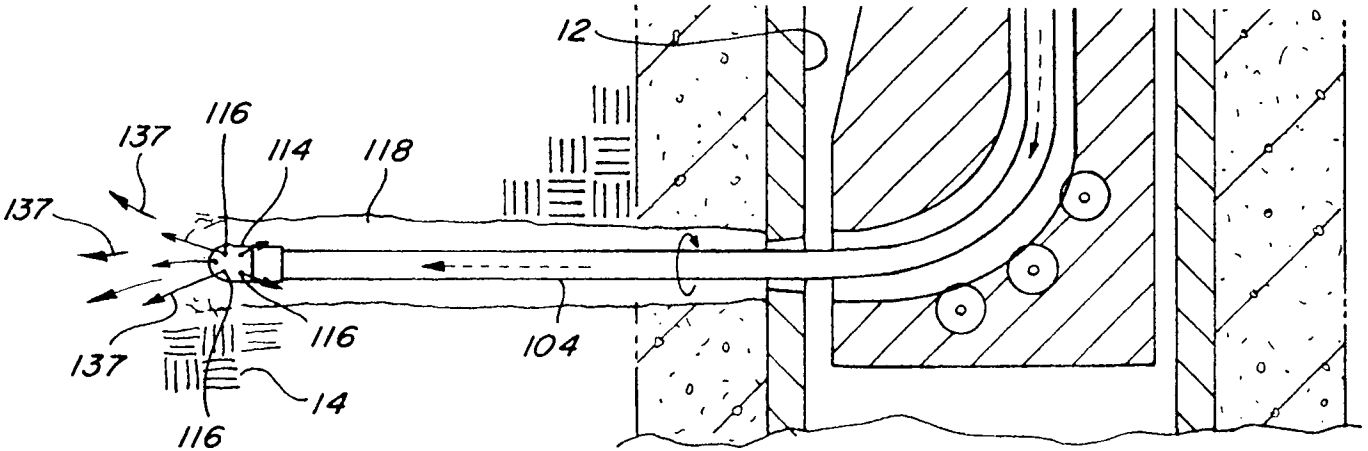
PRIOR ART Fig. 7
FIG. 7 is a fragmentary side elevational view of the apparatus of FIG. 4 showing an acid or a gas being injected into the extension of FIG. 6.

Referring to FIGS. 1 and 7, after extension 118 has been drilled to a desired extent, the hydrostatic head can be allowed to again build up. Then, once the hydrostatic head is sufficiently high, an acid, mixture of acid and another substance, or a gas contained in a tank 135 on the earth's surface 18 can be injected into flexible tubing 32 under pressure supplied by compressor 133, pump 34 or another suitable device, so as to be conveyed through flexible tube 104 to nozzle 114 and discharged through apertures 116 thereof into strata 14 surrounding extension 118. This has been found to be an advantageous procedure, as the acid, mixture or gas is delivered in a pristine condition to the strata surrounding extension 118, for etching or otherwise reacting with alkaline materials in the strata, for increasing the production potential at that location. Here, the presence of the hydrostatic head has been found to provide a pressurized condition in well casing 12 which is sufficient to maintain the acid or gas localized within extension 118 where it is desired.

Figure 8:
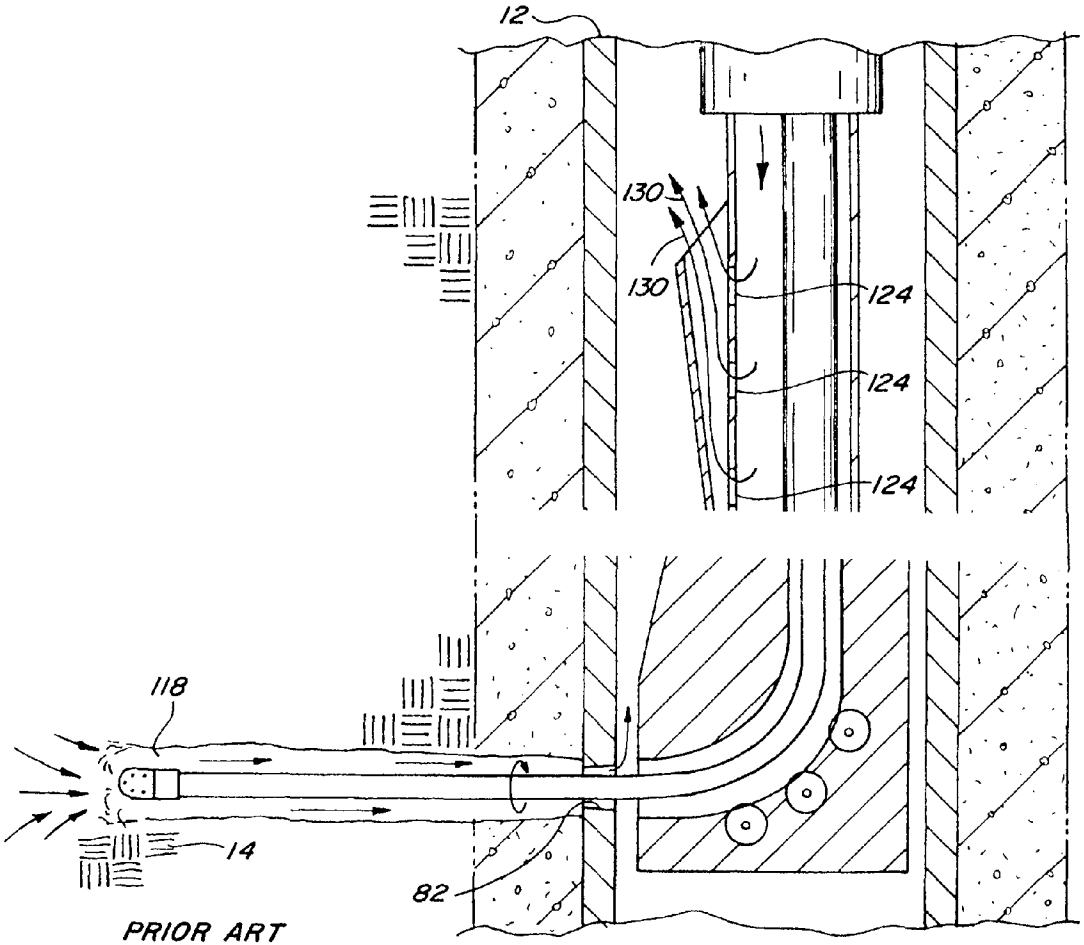
FIG. 8 is a fragmentary side elevational view of the apparatus of FIG. 4 showing flow of material from the extension during reduction of the hydrostatic head.

Referring also to FIG. 8, after a sufficient period of time for the acid or gas to perform its desired function has elapsed, the hydrostatic head can be reduced, such that the acid, gas and/or reaction products can flow from the strata 14 in the vicinity of extension 118, through hole 82 and into casing 12. It is desirable to have the capability for the materials to be brought to the surface where it can be examined to ascertain the success of the acid or gas injection to determine whether drilling and/or injection should be continued.

As explained in my previous patent it is important to drill extension 118 in the strata so as to be of sufficient size and unobstructed to allow the advancement of nozzle 114 and flexible tube 104 therethrough. This can be achieved by rotation of flexible tube 104 and nozzle 114 using motor 88, or possibly by other means, such as by generating a rotating fluid stream other than by rotation of the nozzle and tube. As a result, extension 118 can have a sectional extent marginally larger than that of nozzle 114 or the other apparatus used for drilling extension 118, to facilitate movement of the nozzle therethrough, and outward flow of particles or cuttings from the extension.

Figure 9:
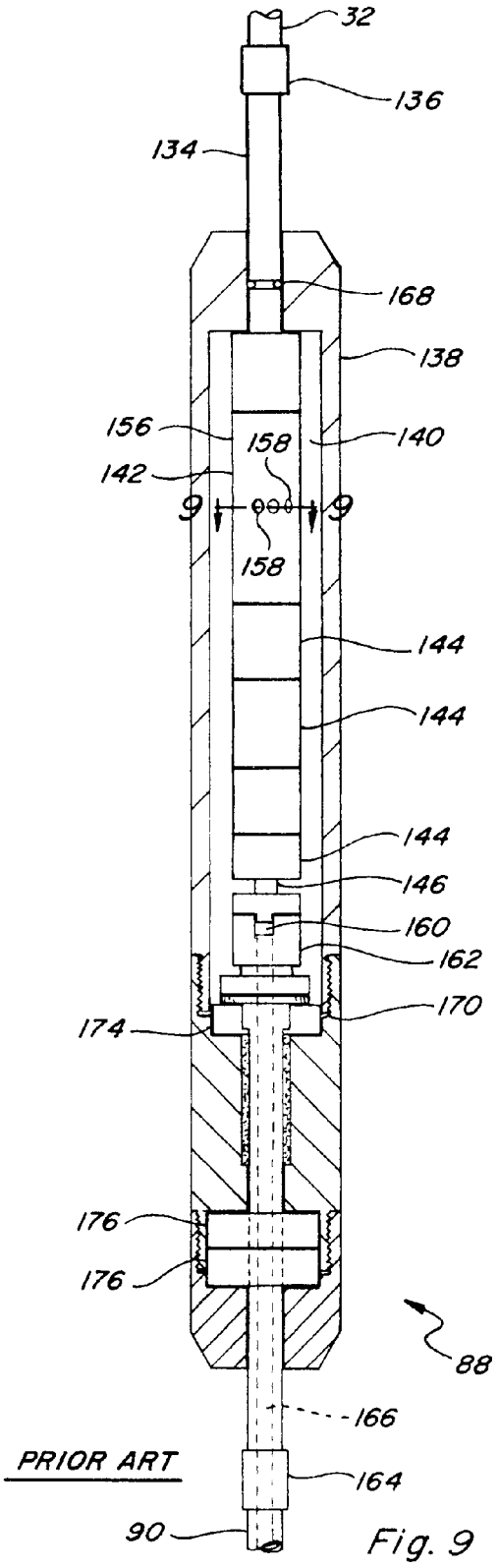
FIG. 9 is a side elevational view of the apparatus of FIG. 4 in partial cross-section.
Figure 9A:
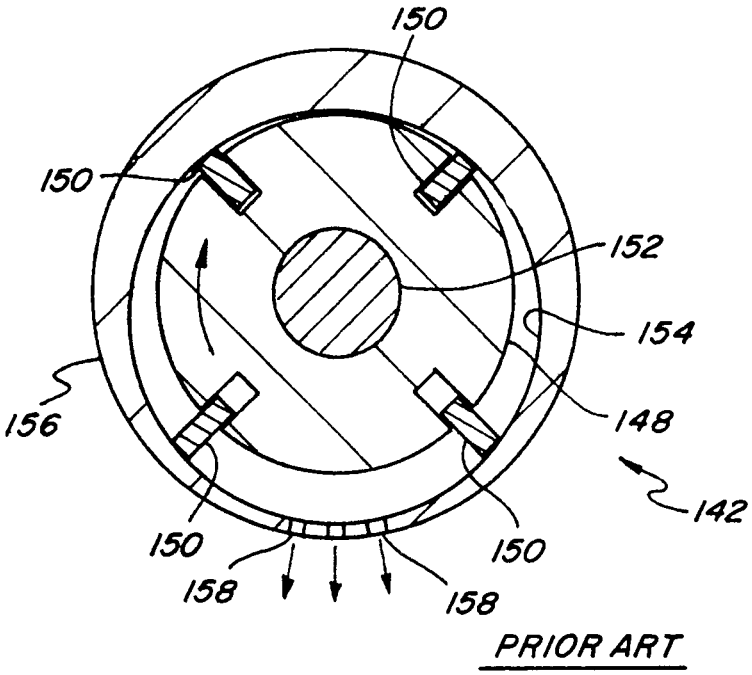
FIG. 9A is a cross-sectional view taken along line 9-9 of FIG. 9.
Figure 10:
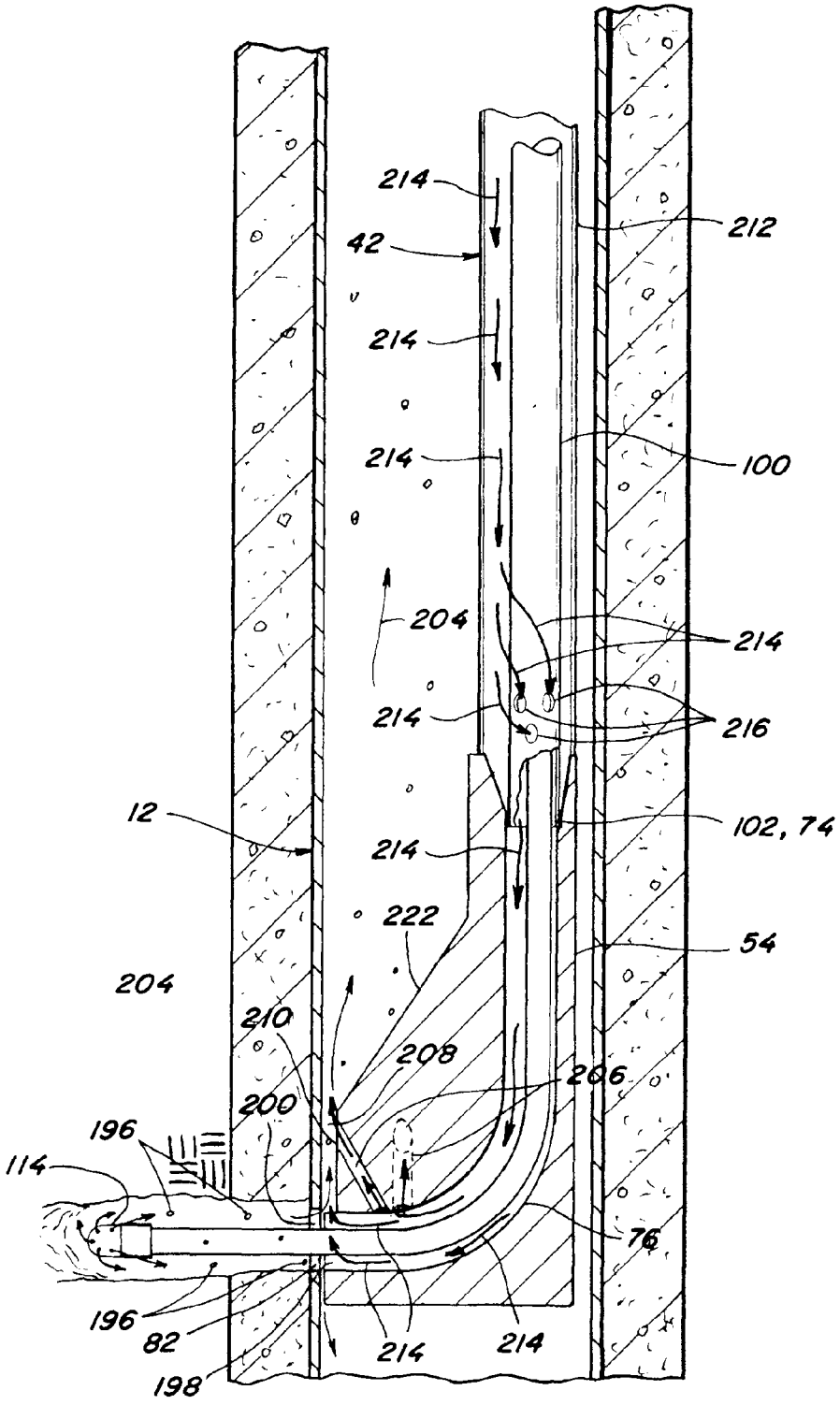
FIG. 10 is a fragmentary side view in partial cross-section of down hole aspects of the apparatus of FIG. 1, modified to include one embodiment of apparatus of the present invention, and shown drilling a lateral passage in a formation, with particles being removed according to the present invention.
Figure 10A:
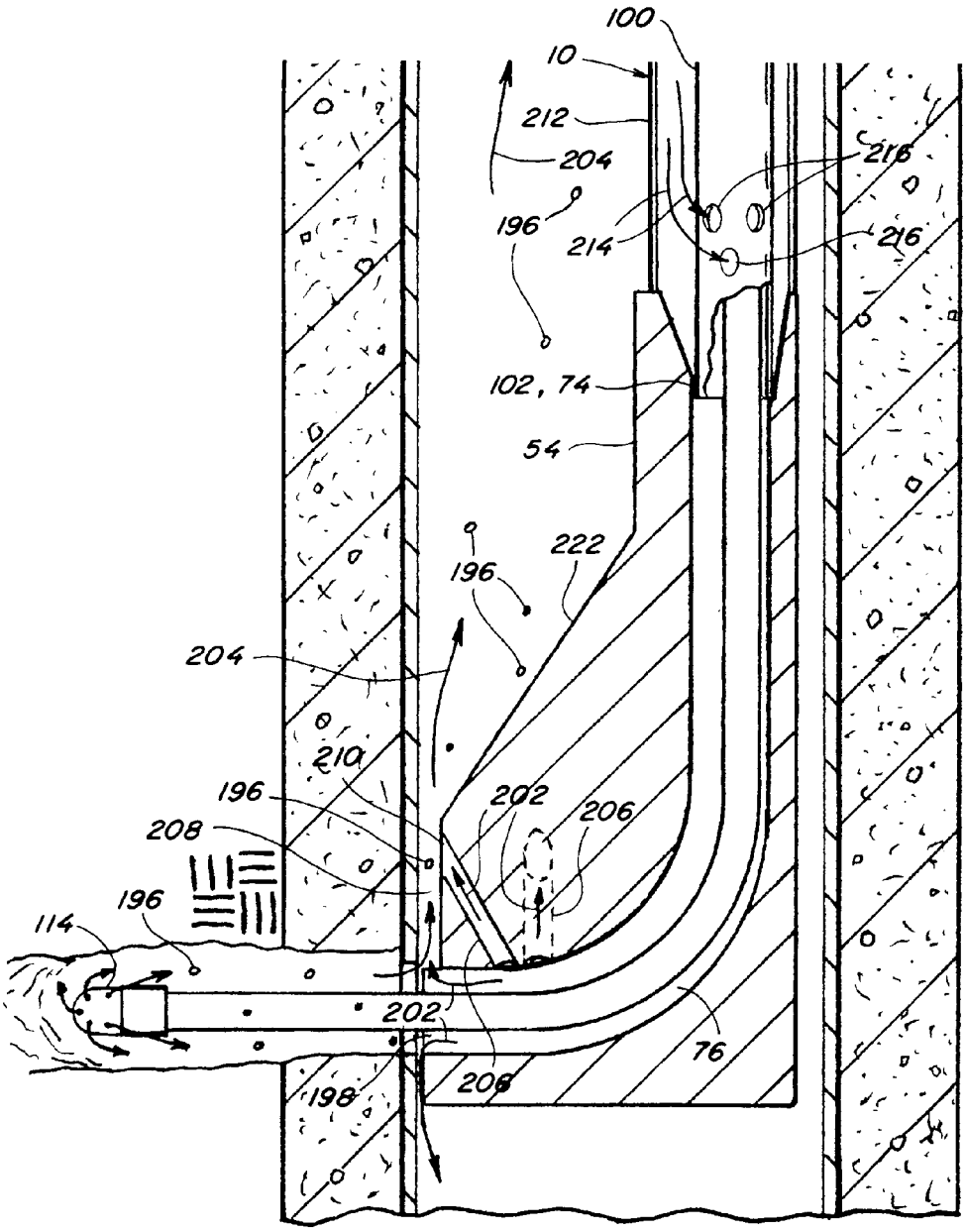
FIG. 10A is an enlarged side view in partial cross-section of down hole aspects of the apparatus of FIG. 10, illustrating flows thereof.
Figure 10B:
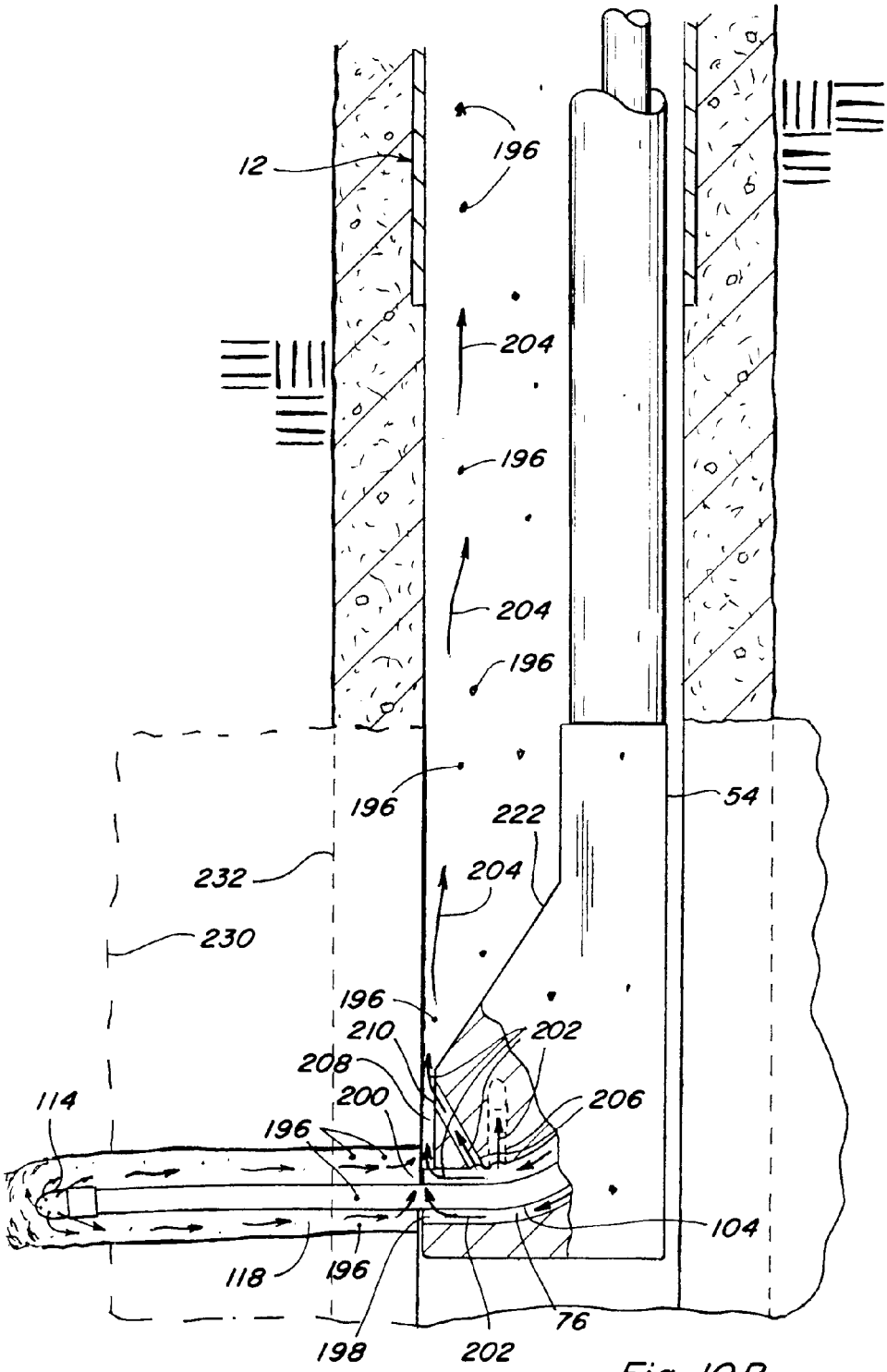
FIG. 10B is another enlarged side view in partial cross-section of the downhole aspects of the apparatus, shown drilling a lateral passage directly in a formation, below a casing of the well.
Figure 11:
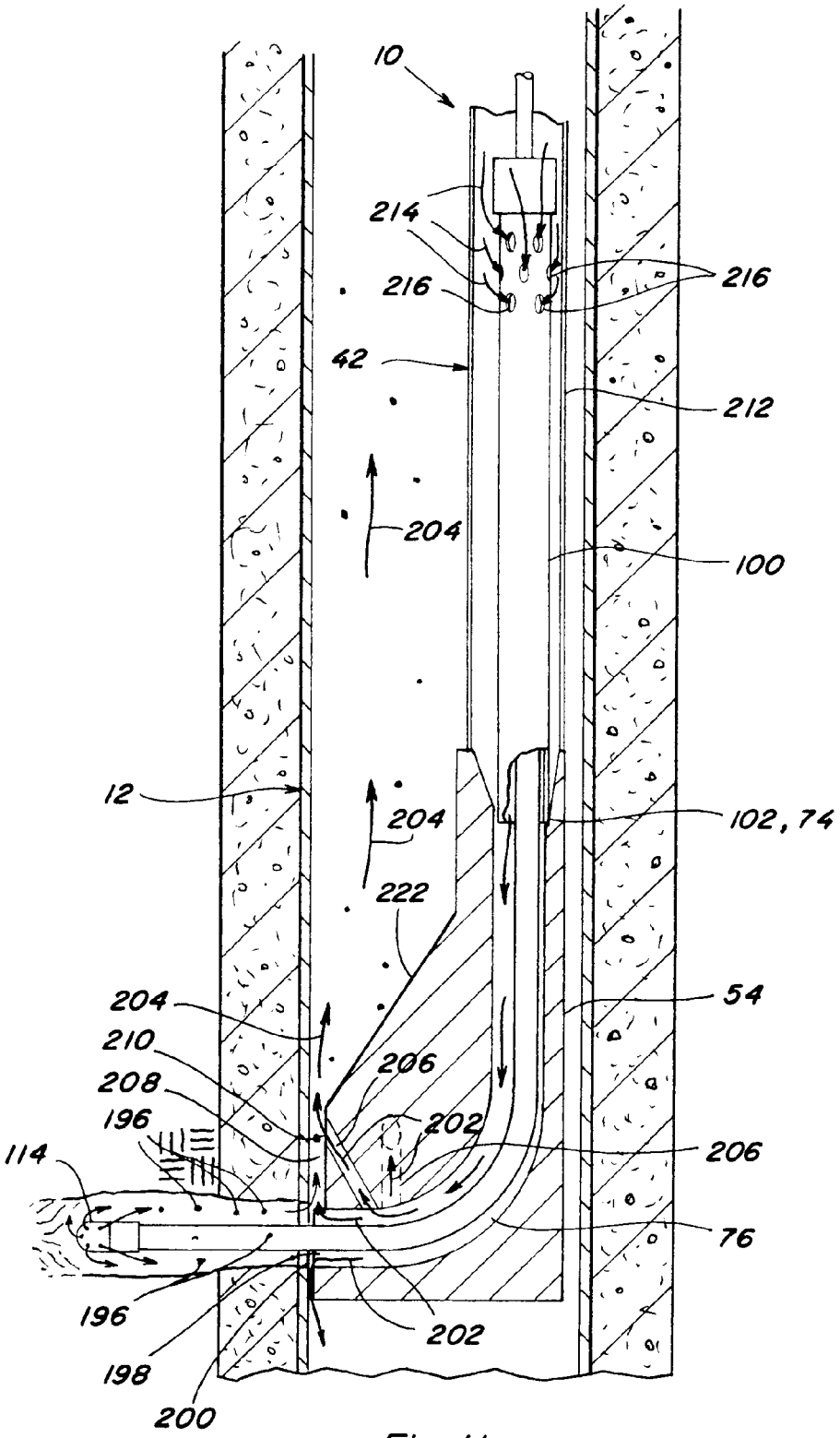
FIG. 11 is another fragmentary side view in partial cross-section of down hole aspects of the apparatus of FIG. 1, modified to include other aspects of the invention, and shown drilling a lateral passage in a formation, with particles being removed according to the present invention.

Turning to FIG. 9, motor 88 is shown. Motor 88 includes an inlet nipple 134 coupled in fluid communication with tubing 32 by a coupler 136 for receiving pressurized fluid from pump 34 therethrough. Coupler 136 also supports motor 88, rigid tube 90, flexible tube 104 and nozzle 114. Motor 88 includes an outer case 138 defining an internal cavity 140 containing a fluid motor unit 142 connected in driving relation to a plurality of gear reducers 144, including a final gear reducer having an output shaft 146 driven by fluid motor unit 142. Referring also to FIG. 9A, fluid motor unit 142 is a vane type fluid motor having an eccentric 148 including a plurality of radially moveable vanes 150 of solid brass, copper or other substantially rigid material. Motor 62 discussed above is constructed essentially the same. Motor unit 142 is connected in driving relation to a drive shaft 152 for relative eccentric rotation to an inner circumferential surface 154 of an inner case 156 under force of pressurized fluid received through inlet nipple 134. The fluid is then discharged from inner case 156 through discharge ports 158 into internal cavity 140 wherein the pressurized fluid travels to an inlet port 160 of a hollow motor output shaft 162. Output shaft 162 passes through outer case 138 and is coupled to rigid tube 90 by a coupler 164. Output shaft 162 includes an internal passage 166 thus connected in fluid communication with internal passage 112 through tube 90 and tube 104, for delivering the pressurized fluid to nozzle 114.

As noted above, the pressurized fluid carried through tubing 32 to motor 88 can be at a pressure of as high 10,000 psi or greater. To enable motor assembly 88 to withstand and contain such pressures without significant leaking, an O-ring 168 is located around inlet nipple 134, a second O-ring 170 extends around the juncture of two parts of outer case 138, and a series of O-rings or packing 172 extend around motor output shaft 162 as it passes through case 138. Additionally, a thrust bearing 174 and ball bearings 176 are provided in association with output shaft 162 for the smooth rotation of tubes 90 and 104, and nozzle 114.

Referring also to FIGS. 10, 10A, 10B and 11, as casing 12 is being cut, whether with a mechanical cutter 70 as described above, or with an abrasive stream or in another manner; as the formation is being drilled; and/or as the extension is being cleaned out with high pressure fluid, e.g. after an acid injection or otherwise, particles 196 including cuttings (and abrasives if used) will be discharged or expelled from hole 82 through casing 12 (if present). Hole 82 and extension 118 will be aligned with and in opposing relation with a lateral opening 198, defining an interface 200 therebetween. Interface 200 will typically comprise either a small gap or space, but can also comprise an abutting relationship. In either instance, it has been found that at least some of particles 196 discharged or expelled from hole 82 and/or extension 118 can possibly pass through interface 200, so as to enter lateral opening 198 and build up in elbow 76. This build-up has been found to be sufficient, in some instances, to interfere with movements of flexible tube 104, including both longitudinal movements into and along extension 118, and withdrawal therefrom, and also rotary movements, as noted above. This build-up of cuttings in the elbow can even be sufficient, in some instances, such that the tube 104 must be abandoned in the extension.

To avoid or at least minimize such build-up of particles in elbow 76, and the resultant problems, the present invention directs at least one pressurized stream or flow of gas, or emulsion of gas and a suitable material, such as, but not limited to, a soap, drilling foam or foaming agent, denoted by arrows 202, in a manner for directing particles 196 that are discharged from hole 82 and/or extension 118, away from lateral opening 198. The stream or streams of gas or emulsion 202 can be directed in any suitable direction for carrying the particles away, but it is most preferred for the stream to carry the particles upwardly within the well, as denoted by arrows 204. My previously disclosed air jets 124 (FIGS. 6, 8), will be eliminated or not used, and if present will preferably be rendered largely or completely inoperable, such that the bulk or all of the flow will be discharged as shown by arrows 202 and 204 from and/or in the vicinity of lateral opening 198, such that the particles will be carried upwardly, preferably to the surface. Also, if abrasives are used in the drilling operation, for example, but limited to, as disclosed in my copending U.S. patent application Ser. No. 12/350, incorporated in its entirety herein by reference, those particles will be carried away.

According to preferred aspect of the invention, a flow of pressurized gas or emulsion, denoted by arrows 202 is directed through elbow 76 and into the annulus between the inner surface of casing 12 and shoe 54 through lateral opening 198. In this instance, because the gas or emulsion will be discharged from lateral opening 198 in essentially opposition to the fluid and particles 196 including cuttings (and abrasives, if used) discharged from hole 82 and/or extension 118, the pressure of the gas or emulsion exiting opening 198 should be at least marginally less, or otherwise of a different nature than that exiting hole 82 and/or extension 118, so as not to prevent the discharge of the particles 196 from the hole and/or extension, including any abrasive particles if used in the drilling of the drilling of the casing and/or the extension, with the net effect that the particles (including abrasives if used) will be redirected in a direction other than into lateral opening 198, and preferably such that abrasives 196 are redirected upwardly. It is preferred to use a gas, such as, but not limited to, air, carbon dioxide, nitrogen, a combination of these, and/or other inert gas, which beneficially has less density compared to the liquid discharged from hole 82 and/or extension 118, pressurized so as to be discharged from lateral opening 198 at a desired pressure. The gas can also be used in emulsion with a soap, drilling foam or other foaming agent, or a combination of these. Using a gas such as air or the others, either alone, or in an emulsion, will also mix with the liquid within the well casing comprising the hydrostatic head to reduce the weight of the hydrostatic head, to result in the desired upward flow of the particles and liquid, as the liquid and gas or emulsion will be lighter. As another preferred aspect of the invention, shoe 54 will include at least one additional passage 206 in connection with and emanating from elbow 76 and extending to the exterior of the shoe, for flows of the gas or emulsion, as also denoted by arrows 202, therethrough and therefrom. Passage or passages 206 are preferably directed or oriented upwardly, but can be otherwise directed, for providing additional capacity for generating upward gas or emulsion flow in the vicinity of shoe 54. The presence of passages 206 can also facilitate regulating the pressure of the gas or emulsion exiting opening 198, by providing essentially a pressure relief route for the gas or emulsion. Additionally, the pressurized gas or emulsion exiting opening 198 and passage or passages 206 can be sufficient in quantity and pressure, to have the capability for contributing to the lowering or removal of any hydrostatic head in the well, by carrying liquid in the bottom of the well upwardly to the surface, or to other outlets (see below) so as to travel up the well therewith.

Another preferred element of the invention is a slot or relief 208 on the exterior of shoe 54, extending upwardly from lateral opening 198, which functions in cooperation with the opposing surface of casing 12, for providing a pathway for guiding cuttings 204 upwardly between casing 12 and shoe 54. The sideward dimensions of relief 208 can be selected for best effect.

Additionally, as another preferred aspect of the invention, at least one passage 206 extends upwardly through shoe 54 to a discharge outlet 210 in connection with relief 208, for directing a flow of the pressurized gas or emulsion 202 thereto, for facilitating the upward flow of the particles past shoe 54.

The pressurized gas or emulsion is preferably delivered to elbow 76 through sheath 100 (FIGS. 10, 10A and 11), as denoted by arrows 214. To facilitate this, terminal end 102 of sheath 100 forms a sealed condition with beveled edge 74 on the top of shoe 54. The pressurized gas or emulsion 214 will preferably be received from a source on the surface, which will be a pump or compressor, such as compressor 126 used for providing compressed air to jets 124 of my earlier invention), but in the case of the present invention the gas or emulsion will be directed to elbow 76. If an emulsion is used, the emulsifying agent, e.g., soap, foam or foaming agent, can be added to the gas stream in a suitable manner, such as by utilizing a pump operable for doing so in a desired proportion to the gas. The pressurized gas or emulsion 214 will be communicated down hole via tubing, piping or other suitable conduit, preferably comprising tubing 40 (FIG. 1) and down hole unit 42. Here though, air jet tube 52 (FIG. 1) is preferably modified such that air jets 124 are rendered inoperable or have regulated or reduced output, or replaced, as denoted by solid tube 212 operable for carrying the pressurized gas or emulsion downwardly to sheath 100. Sheath 100, in turn, is modified to include holes 216 therein for receiving the pressurized gas or emulsion 214. Here, note that holes 216 can be located at a desired location or locations on sheath 100 (e.g., lower location illustrated in FIG. 10 and higher location illustrated in FIG. 11). If tube 212 is used, pressurized gas or emulsion 214 will be communicated down hole at sufficient pressure and in sufficient quantity for performing the double function of reducing the hydrostatic head by a desired amount, and removing the cuttings from the well. That is, the pressurized gas or emulsion will be capable of carrying liquid and cuttings upwardly through the well to the surface, as denoted by arrows 204.

Figure 12:
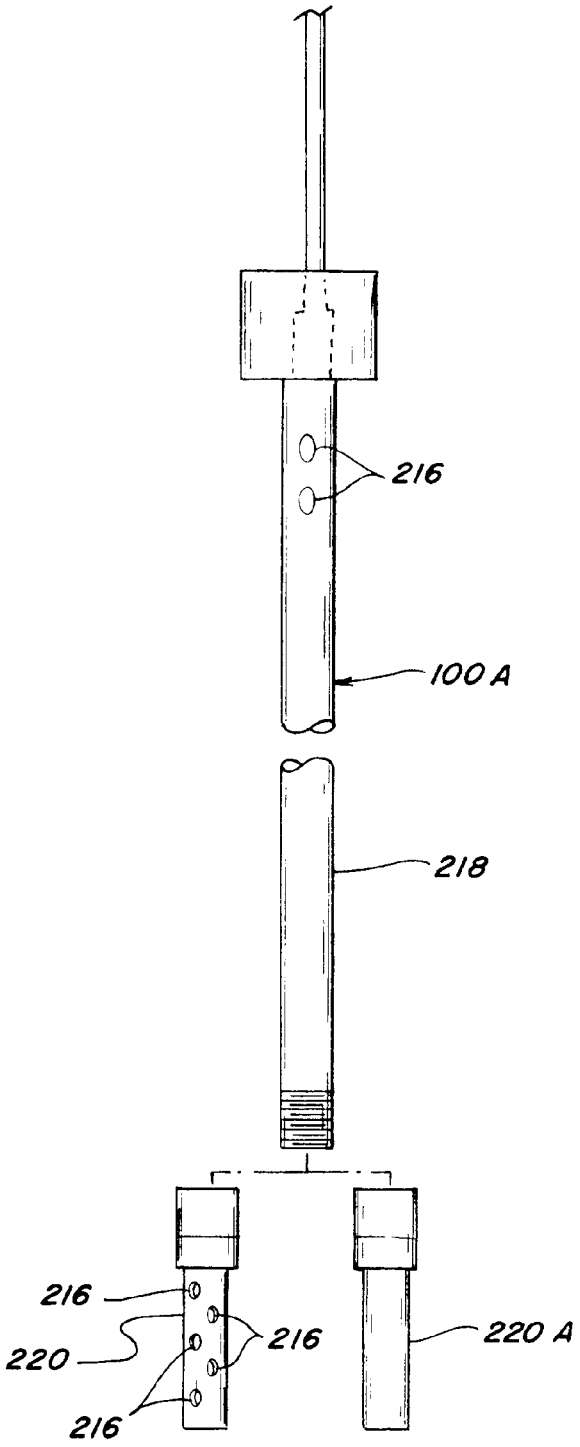
FIG. 12 is a side view of alternative sheath constructions of the present invention.
Figure 13:
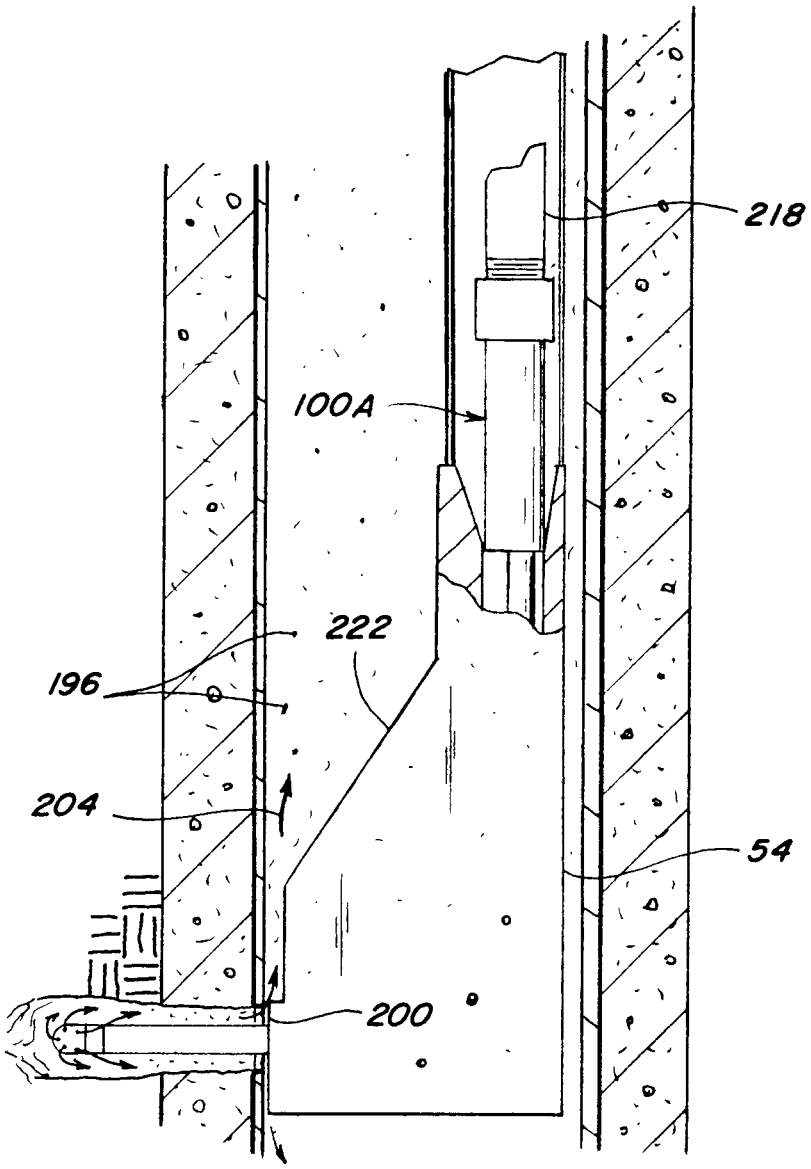
FIG. 13 is a fragmentary side view of the apparatus of FIG. 12 in operation for drilling a lateral passage in a formation and removing particles therefrom.

Referring also to FIGS. 12 and 13, an alternative sheath 100A is illustrated which is of two-piece construction, including a tubular main sheath body 218 supported in the above described manner, and interchangeable tubular lower tips 220 and 220A, which are threadedly engageable or otherwise connectable with the lower end of body 218, respectively. The difference between the tips is that tip 220 includes holes 216 for pressurized gas or emulsion flow to the interior of tube 218, in parallel with flow through holes 216 in the upper end of tube 218, for providing an increased flow capacity. Tip 220A does not include holes 216, and thus the flow to the interior of the tube 218 will be through the upper holes 216 only and thus less capacity is provided. The ability to use either tip 220 or tip 220A provides interchangeable manners of controlling the volume of pressurized gas or emulsion flow to shoe 54, to enable adapting to conditions in a particular well.

As another optional feature of the invention, shoe 54 is illustrated in FIGS. 10, 10A, 10B, 11 and 13, having a more gradually sloped front surface 222 located above interface 200, compared to the steeper surface of shoe 54 of FIG. 1, which is intended to facilitate easier upward flow 204 of particles 196.

Figure 14:
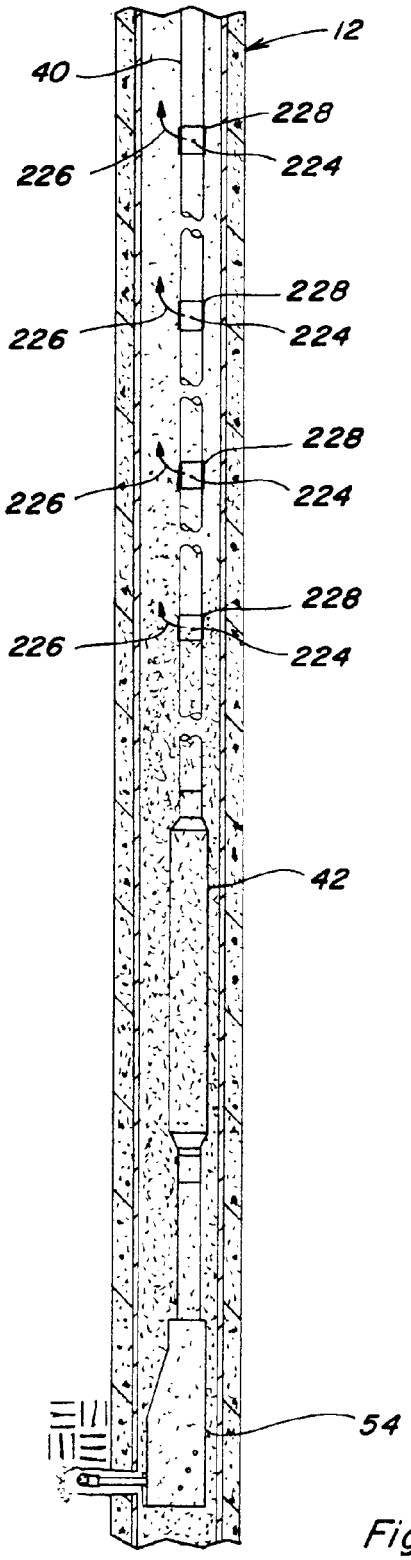
FIG. 14 is a fragmentary sectional view of additional apparatus of the present invention operable for moving particles upwardly through a well.
Figure 15:
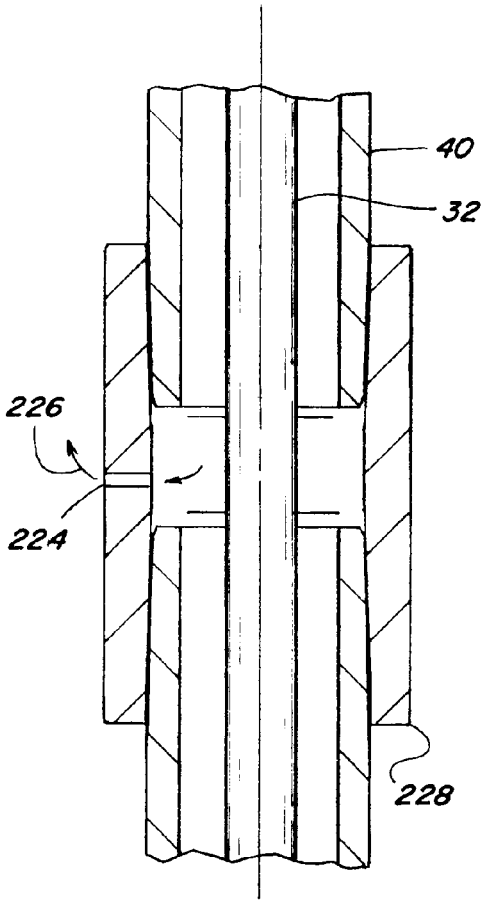
FIG. 15 is a sectional view of a portion of the apparatus of FIG. 14.
Figure 16:
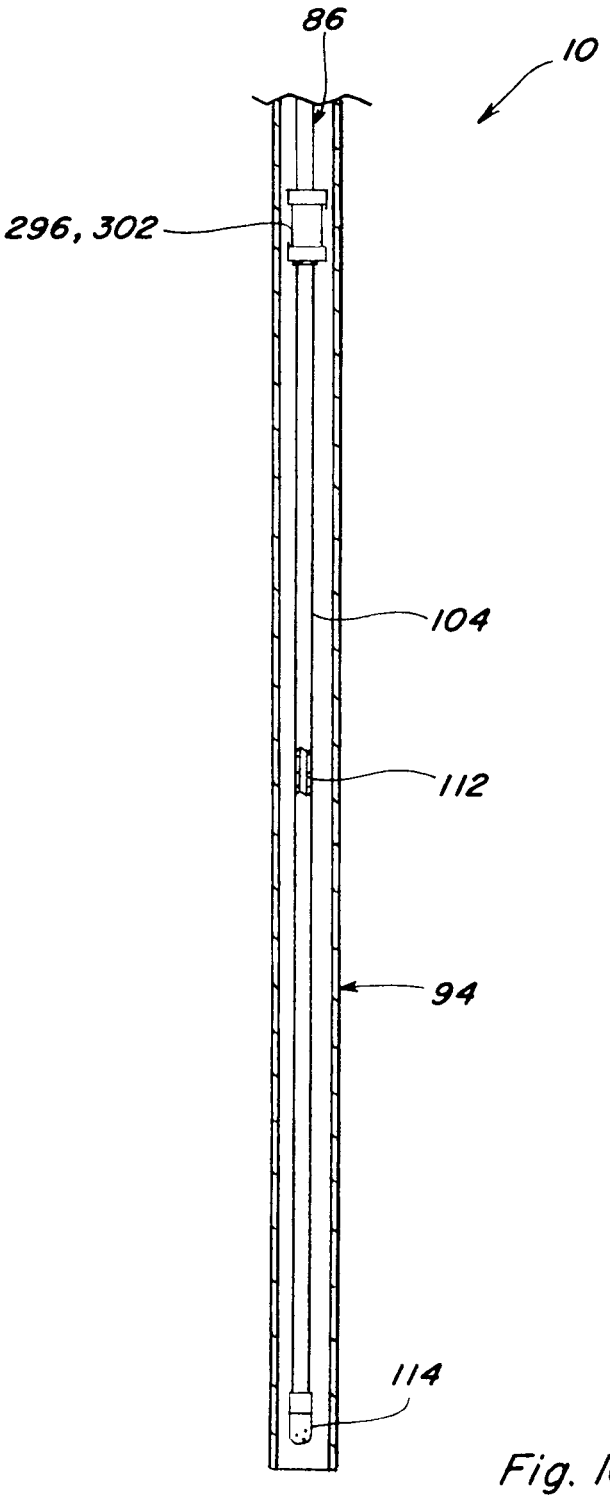
FIG. 16 is another fragmentary side view in partial cross-section of the apparatus of FIG. 4, including apparatus for introducing abrasives into fluid flow to a nozzle of the apparatus.
Figure 17:
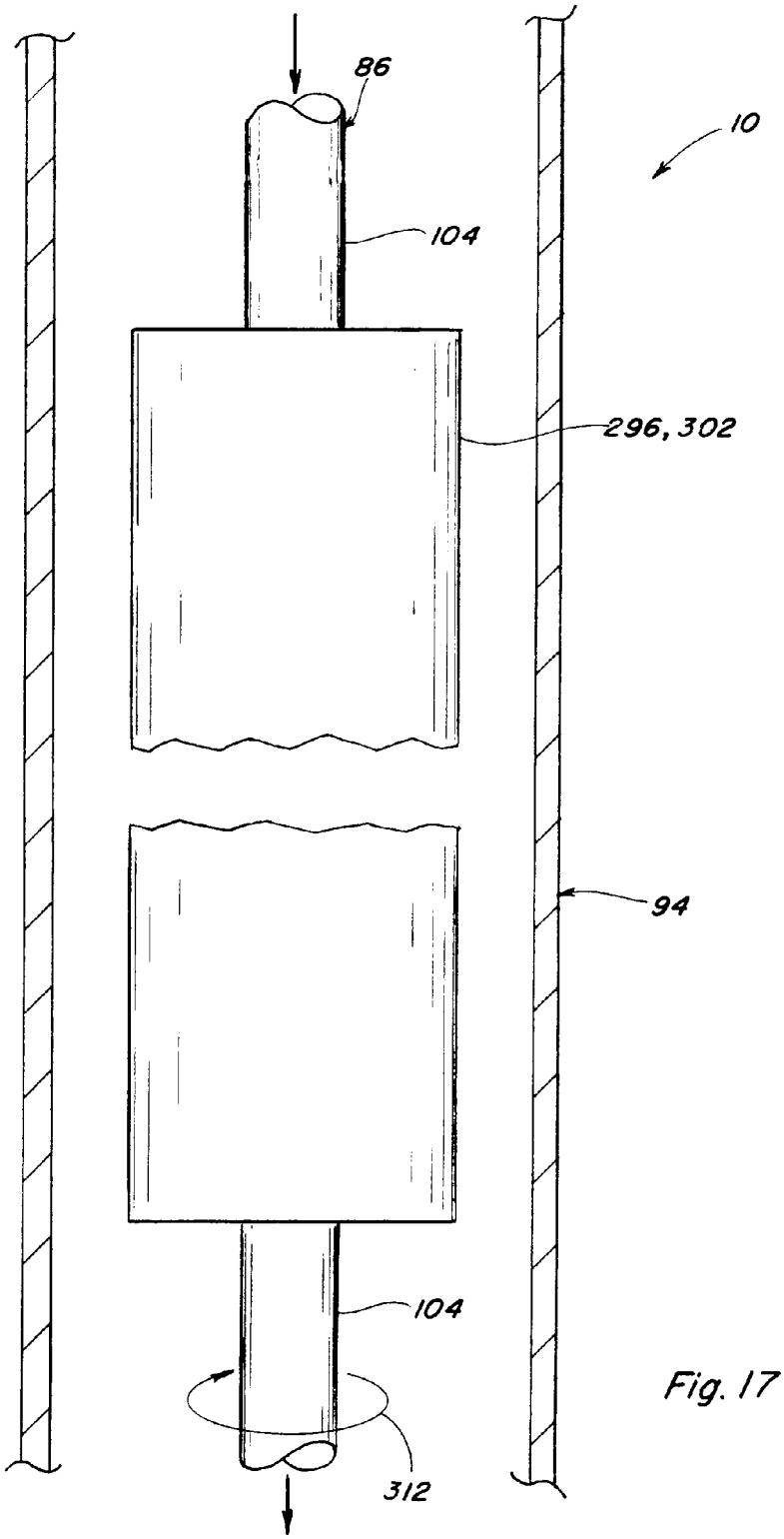
FIG. 17 is an enlarged fragmentary side view of the apparatus of FIG. 16.
Figure 18:
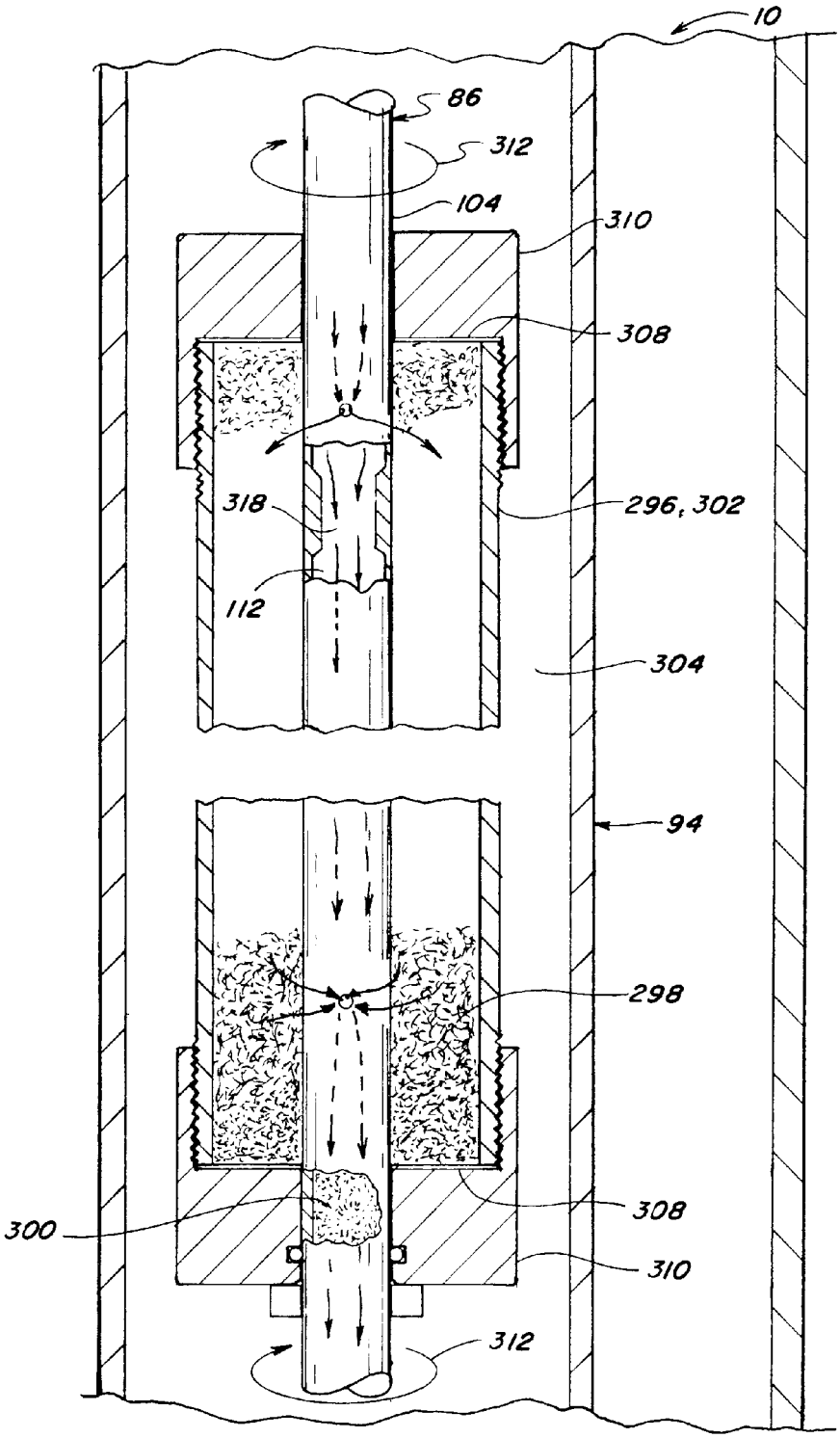
FIG. 18 is another enlarged fragmentary side view of the apparatus of FIG. 16, in partial cross-section to show internal aspects thereof.

Referring also to FIGS. 14 and 15, it has been found that for some applications, the hydrostatic head in a well, that is, the column of liquid therein, will be of a height so as to generate a pressure condition in the well which could counter the pressure of the gas or emulsion to be discharged at shoe 54 for removing the cuttings and other particles. In this regard, it is contemplated that pressures to be used for removing the particles and cuttings can be as great as about 1000 psi, and more typically about 350 psi as a non-limiting example, and in this latter regard, the hydrostatic head present in the well may be sufficiently great, at least initially, so as to prevent the pressurized gas or emulsion from reaching shoe 54. In particular, the hydrostatic pressure, at least initially, can be sufficiently high, so as to interfere with or reduce the ability of the apparatus of the invention to discharge pressurized gas or emulsion into the well at the level of shoe 54. To reduce the hydrostatic head under these conditions to improve the pressurized gas or emulsion flow, a portion of tubing 40 disposed above and supporting down hole unit 42 via tubing 32, and/or an upper region of unit 42 itself, can incorporate one or more pressurized gas or emulsion discharge nozzles or orifices 224, operable for discharging a portion of the pressurized gas or emulsion, e.g., compressed air, denoted by arrows 226, at a higher location or locations in the well casing 12, for advantageously lifting fluid of the hydrostatic head, without having to lift a column of fluid equal to the entire height of that portion of the hydrostatic head located above shoe 54.

According to a preferred embodiment of the invention, orifice or orifices 224 are preferably incorporated into couplers 228 which connect together sections of tubing 40 via threads or other common fastener means, and will preferably have a size, e.g., diameter, of a small fraction of an inch, such as, but not limited to, ⅛th inch or less. The location or locations of orifice or orifices 224 can vary for different wells, but, for instance, could be at several intervals along the depth of the well, e.g., at 400 foot intervals, or the orifices can be concentrated at a single location. Generally, orifices 224 will be located at a depth or depths in a particular well as required for satisfactorily reducing or removing the hydrostatic head, and boosting the upward flow of the cuttings and other particles.

It should be noted that for some applications, forming a lateral passage in a formation can take a substantial amount of time, for instance, several days. At times, when the drilling apparatus is not being used, and the hydrostatic head is not being actively reduced, it may increase in height substantially. The utilization of discharge outlets, such as orifices 224 at a higher elevation or elevations with any well, will introduce gas or emulsion into the liquid at the higher elevation or elevations, to reduce the weight of the column of liquid, to facilitate its removal.

Additionally, in some wells, for instance, in some coal bed methane wells, it has been found that the hydrostatic head can be so great as to not be removable or reducible utilizing pressurized gas or emulsion outlets in the lower region of the well only. For instance, if a gas compressor operable for compressing a gas to 350 psi at the surface is utilized, the compressed gas would only be able to lift a column of liquid having a height of about 808 feet. If a higher hydrostatic head is present, that compressor would be unable to remove the hydrostatic head just from the bottom. This would necessitate raising the down hole apparatus to a level at which the pressurized gas or a motion could be discharged. However, if, the lateral passage into the formation already exists, it would be difficult or impossible to relocate the apparatus for continued use of that passage. Therefore, apparatus including orifices 224 at a higher elevation, would have utility in this instance.

As another advantage of providing one or more orifices 224 for discharging the pressurized gas or emulsion at a higher elevation or elevations within a well, this will serve to reduce the pressure of the gas or emulsion at the outlets, e.g., lateral opening 198 and outlet or outlets 210, which can reduce the propensity for driving particulates, such as fines, present in the liquid within the well, into the surrounding formation. This can be particularly advantageous in coal bed methane wells.

Referring again to FIG. 10B, it should additionally be noted that in addition to utility for preventing cuttings, abrasives and other particles from entering shoe 54 when closely adjacent to hole 82 or extension 118, the present invention has utility for preventing such entry when drilling an extension into a surface of an under-reamed portion of a well, such as denoted in dotted lines by surface 230, or another surface such as denoted by line 232, located some distance from shoe 54. Here, cuttings, abrasives and other particles generated by the drilling operation may be present in liquid in that region of the well, and using the teachings of the invention, it is possible to provide sufficient fluid flow from opening 198 and also 210 if present, to prevent build-up in elbow 76.

Thus, it is apparent that the apparatus of the invention can be configured in a variety of ways as required or desired for removing cuttings, abrasives and liquid from the interface between the well casing or formation and the down hole apparatus such as a kick-off shoe. The shoe can be configured for discharging the pressurized gas or emulsion from just the laterally facing opening, or from that opening and one or more other discharge outlets, which can be connected together internally, for distribution and for ensuring that the pressure of the gas or emulsion discharged from the laterally facing opening will not prevent or substantially reduce fluid, cuttings and abrasives (if used) flow from the hole in the casing or formation. This is possible without the air jets of my previous invention, and/or with my discharge outlets or orifices just discussed for removing or reducing the hydrostatic head above the down hole apparatus.

Referring also to FIGS. 16, 17, 18 and 19, apparatus 10 can be optionally configured so as to be capable of introducing abrasives into the fluid stream discharged from nozzle 114 during the drilling operation. This is advantageous as it enhances the drilling capability, including to drill through harder formations and cement surrounding the well casing, and also optionally for drilling through the casing itself, so as to eliminate the necessity of separate casing drilling apparatus, e.g., drill unit 60 and casing cutter 70 discussed above. In a preferred embodiment of the invention, strata drilling unit 86 is configured to include an abrasives addition unit 296 in connection or cooperation with flexible tube 104, below or downstream of motor assembly 88 (FIG. 4), for introducing abrasives, such as, but not limited to, abrasive particles of sand, Garnets, and/or the like, denoted by number 298 in FIG. 18, into the fluid flow through internal passage 112, as denoted at 300, for discharge with the flow through the openings of nozzle 114, e.g., as shown in FIGS. 6, 7 (for cutting or drilling a formation) and FIG. 19 (for drilling a casing). Here, it should be noted that abrasives addition unit 296 can be utilized in cooperation with set down device 94 discussed hereinabove, but is not limited for use with that device.

Abrasives addition unit 296 preferably includes a container 302 having an internal cavity 304 containing abrasives 298. Container 302 can be suitably supported in connection with tube 104, at a desired location below or downstream of motor assembly 88. For instance, a shoulder washer 306 can be soldered, swaged, or otherwise fixedly connected to tube 104 at the appropriate location, for supporting container 302 about tube 104. Container 302 can be fixed to tube 104, so as to be rotatable therewith, as denoted by arrows 312, or so as to allow rotation of tube 104 relative to or within the container, as desired. Container 302 can be of cylindrical or other desired shape, and can include one or more openings 308 enclosed by a suitable cover structure, such as an end cap 310, threadedly or otherwise engaged with container 302, to allow accessing internal cavity 304. Here, tube 104 extends through container 302, although it should be recognized that other constructions that provide communication between internal cavity 304 of container 302 and internal passage 112 of tube 104, can be utilized. Tube 104 includes a first orifice 314 connecting upper regions of internal passage 112 and internal cavity 304, to allow entry of the pressurized fluid from tube 104 into internal cavity 304. Tube 104 includes a second orifice 316 downstream of first orifice 314, connecting lower regions of internal passage 112 and internal cavity 304, to allow entry of abrasives 298 into internal passage 112 from internal cavity 304. And, tube 104 includes an internal restricted orifice 318 between first and second orifices 314 and 316. Restricted orifice 318 provides a pressure drop from first orifice 314 to second orifice 316, to facilitate flow of abrasives 298 from internal cavity 304 of container 302, into internal passage 112 of tube 104. Essentially in this regard, it is desired to provide a means for directing a desired flow of abrasives 298 into the fluid flow through internal passage 112, which is provided in a preferred embodiment by the pressure reduction achieved using restricted orifice 318, although it is recognized that other structures may provide this capability.

Figure 19:
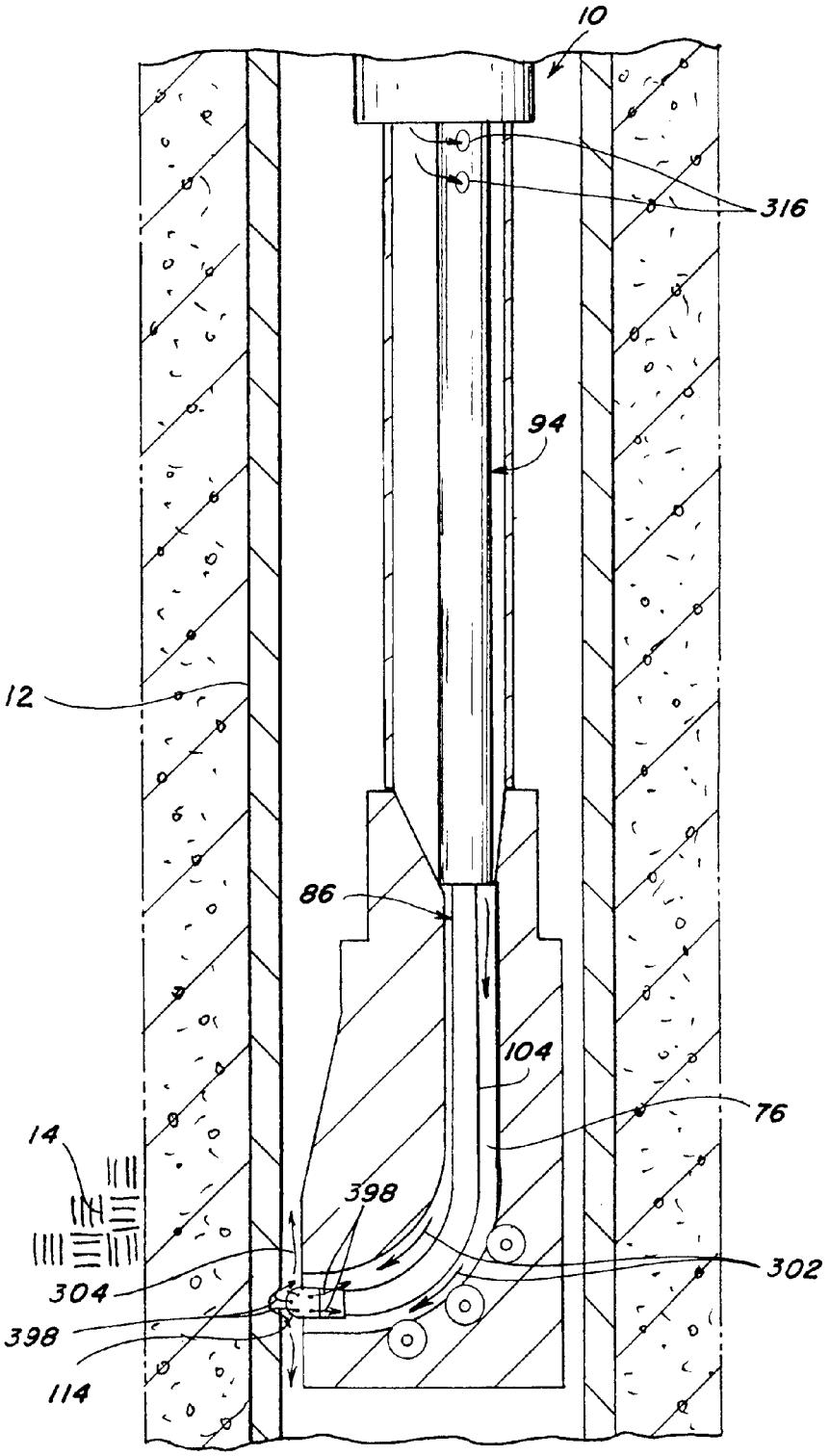
FIG. 19 is still another enlarged fragmentary side view of the apparatus, illustrating drilling through a well casing.

Referring more particularly to FIG. 19 with regard to drilling through casing 12, the mixture of fluid and abrasives 298 will exit tube 104 through the openings of nozzle 114, so as to impinge an adjacent surface of casing 12 in the path of the nozzle so as to drill a hole therethrough. During this operation, it will be desired to direct a flow 202 of gas or emulsion into the sheath, e.g., through holes 216, and through elbow 76 in the above described manner, to prevent any significant build-up of particles therein which could interfere with rotation of tube 104, and also extension and retraction thereof. Flow 202 will be pressurized to prevent such build-up, such that the particles are carried upwardly as denoted by arrows 204, external to the down hole unit, essentially in the above described manner.

Additionally, at other times, it may be desirable to prevent or limit flow of abrasives 298 into tube 104, such as when not actively drilling, or when lowering the tube into a well, or raising the tube. As one reason, loose abrasives 298 may fall to nozzle 114, so as to partially or fully clog or restrict it or a portion of the tube. Because of size constraints, and location (within a well) it is additionally desirable to have the capability of limiting or preventing flow automatically, and only allowing the flow when pressurized fluid is present in tube 104.

Figure 20:
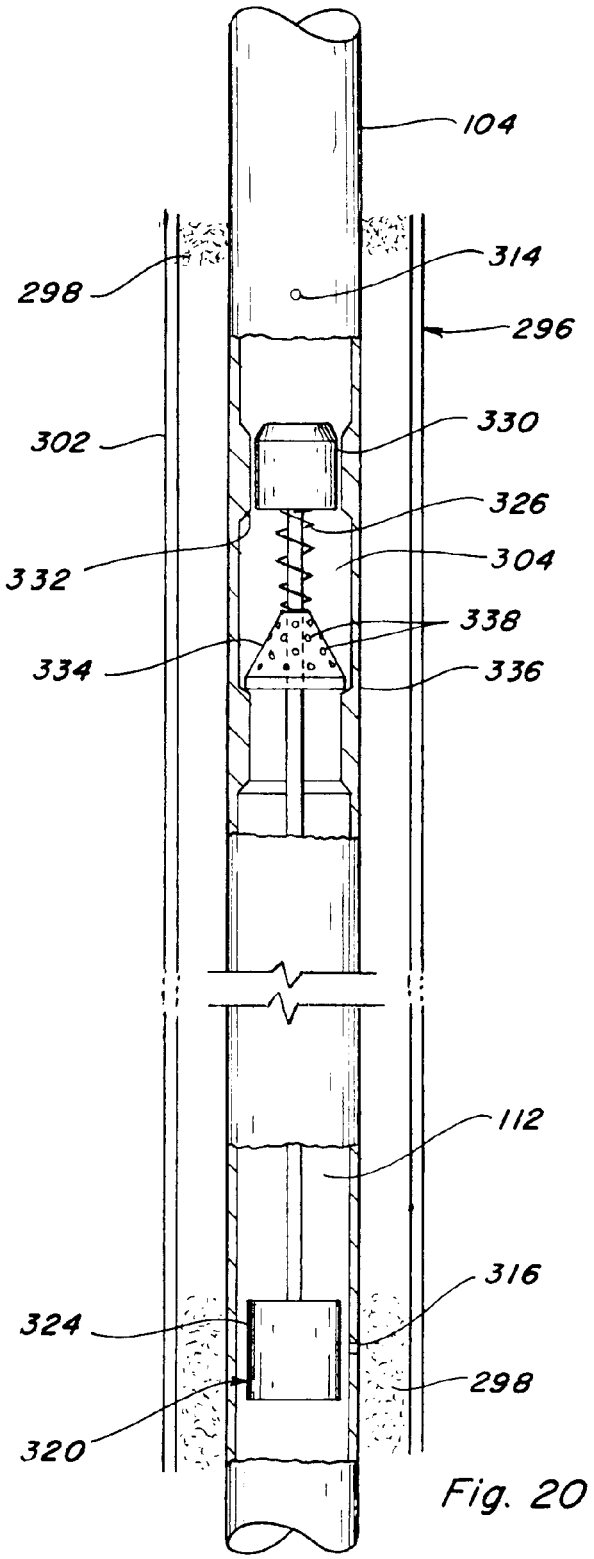
FIG. 20 is another enlarged fragmentary side view of the apparatus of FIG. 10 in cross section, illustrating optional closure apparatus in a closed mode for limiting abrasives flow.
Figure 21:
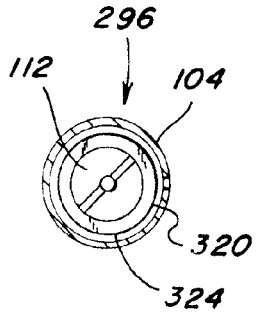
FIG. 21 is an enlarged cross sectional end view of the apparatus of FIG. 20.
Figure 22:
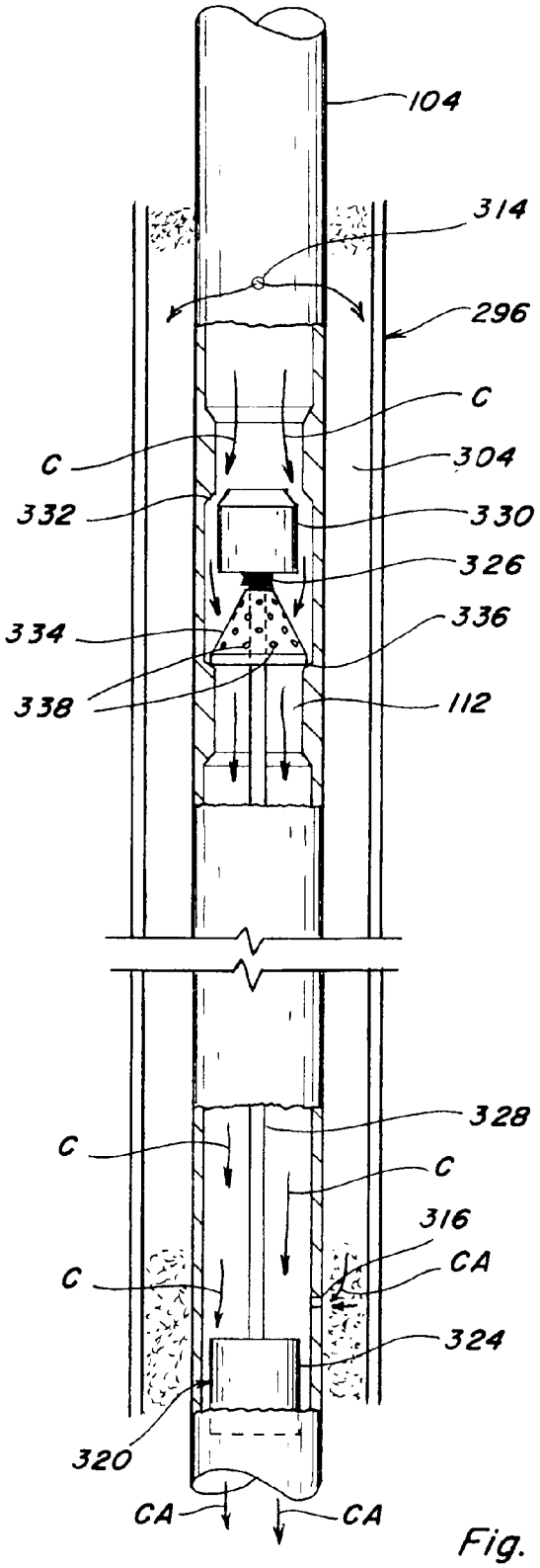
FIG. 22 is another enlarged fragmentary side view of the apparatus of FIG. 20 in cross section, illustrating the closure apparatus in an open mode.
Figure 24:
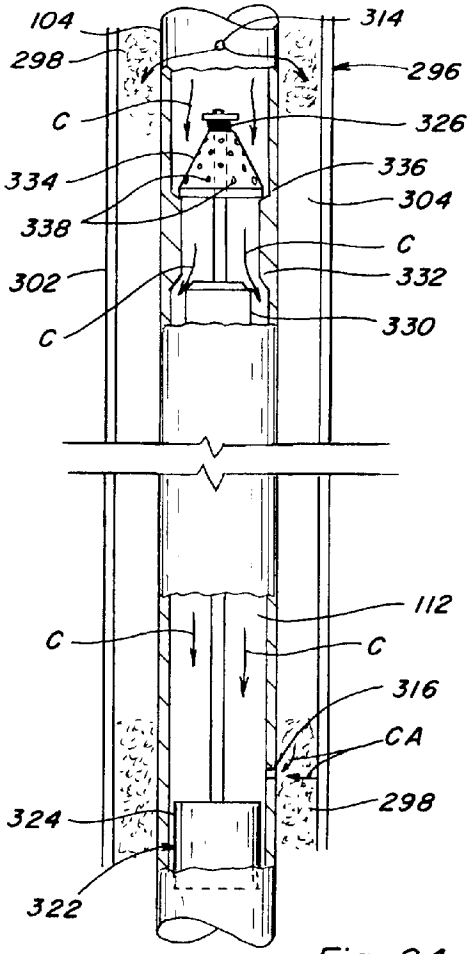
FIG. 24 is still another enlarged fragmentary side view of the apparatus of FIG. 23 in an open mode.
Figure 23:
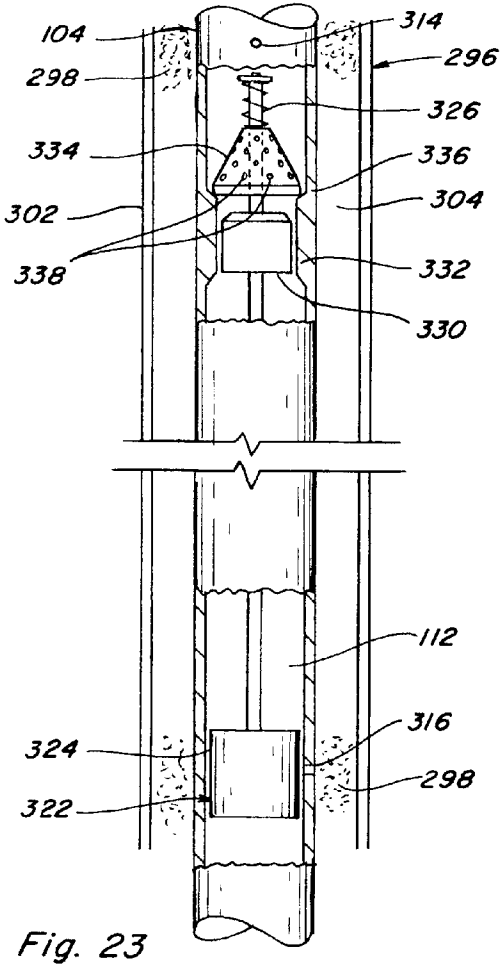
FIG. 23 is still another enlarged fragmentary side view of the apparatus of FIG. 16, illustrating another embodiment of optional closure apparatus in a closed mode for limiting abrasives flow.

FIGS. 20, 21 and 22 illustrate one embodiment 220, and FIGS. 23 and 24 illustrate another embodiment 322 of closure apparatus, constructed and operable for automatically limiting or preventing flow of abrasives 298 from internal cavity 304 of container 302, through second orifice 316, into internal passage 112 of tube 104, when pressurized fluid flow (arrows C) is absent, like parts of apparatus 320 and apparatus 322 being identified by like numbers. Apparatus 320 and 322 are each disposed in tube 104 about coincident longitudinally with abrasives addition unit 296.

Apparatus 320 and 322 each includes a cover element 324 disposed in a closed or covering mode (FIGS. 20 and 23) in generally covering relation to second orifice 316 for preventing or substantially limiting abrasives flow therethrough, and is movable into an open or uncovered mode (FIGS. 22 and 24) spaced from orifice 316, to allow abrasives flow (denoted by arrows CA) therethrough. Cover element 324 is preferably of cylindrical tubular construction to allow flow of fluid C through internal passage 112 therethrough, in both the closed and open modes. Cover element 324 is biased toward the closed mode by a biasing element 326, which can be, for instance, a spring. Cover element 324 is fixedly mounted on the lower end of and supported by a rod 328 which extends longitudinally within passage 112, the upper end of rod 328 fixedly connecting to a valve member 330, also located in passage 112, in proximity to an internal valve seat 332.

Rod 328 is supported in passage 112 by a support element 334, which, in turn, is supported in a suitable manner such as on a shoulder 336 within passage 112. Support element 334 is configured to support cover element 324, biasing element 326, rod 328 and valve member 330, for longitudinal movement relative to shoulder 336, which can be annular or otherwise configured for this purpose.

Support element 334 is configured so as to allow fluid flow therethrough, such as by provision of orifices 338 therethrough.

Biasing element 326 is preferably disposed about rod 328 and urges valve member 330 upwardly toward a restricted passage or valve seat 332, in opposition to fluid pressure thereagainst resulting from fluid flow toward the nozzle, that is, the operating fluid pressure from fluid flow when drilling (some fluid pressure will also be present if a fluid column or hydrostatic head is present in tube 104 above apparatus 320 or 322, and the biasing element 326 should be selected to have a spring constant sufficient to prevent significant opening of cover element 324 under just a hydrostatic head pressure).

Valve member 330 is preferably a solid cylinder, marginally smaller than seat 332. Valve member 330 is preferably configured and located in or against seat 332 in the absence of the operating fluid pressure, but, when the operating flow pressure is present, e.g., flow rate is sufficient, the fluid flow will act against valve member 330 such that biasing element 326 will resiliently yield, to allow cover element 324 to move to the open or uncovered mode. In this mode, a portion of the fluid flow carrying abrasives (arrows CA) will be allowed to flow from cavity 304 through orifice 316 into passage 112, and to the nozzle for drilling, in the above explained manner. Then, when the pressure is reduced, biasing element 326 will urge valve member 330, rod 328 and cover element 324 into or against seat 332, to move cover element 324 to the closed mode, to prevent or substantially limit the abrasives flow.

Here, it should be noted that valve member 330 is only loosely fitted into seat 332, and cover element 324 is only loosely covering orifice 316. This is advantageous, as it facilitates automatic operation, and prevents binding under different temperature and pressure conditions, and in the presents of abrasives and other particulates and contaminants that may be present in the environment.

As examples of representative fluid pressures (gauge readings at the surface) for generating the operating fluid pressures for drilling with abrasives according to the invention, it is contemplated that pressures of 4000 psi or lower can be used, and, in particular, pressures between about 2000 and about 3000 psi can be used.

Additionally, an acid can be used simultaneously with the abrasive drilling.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiments of the invention; however, concepts, as based upon the description, may be employed in other embodiments without departing from the scope of the invention. Accordingly, the following claims are intended to protect the invention broadly as well as in the specific form shown.

What is claimed is:

1. Apparatus for forming a lateral passage in earth strata beside a well, comprising:

a tubular element configured to extend downwardly within an interior cavity of the well, the tubular element including an internal passage therethrough;

a down hole unit connected to the tubular element so as to be supportable thereby at a predetermined depth within the interior cavity of the well, the down hole unit including a lowermost kick-off shoe and a passage extending therethrough including through an elbow extending through the kick-off shoe between an upper opening connecting with the internal passage through the tubular element, and a sidewardly facing lateral opening on the kick-off shoe lower than the upper opening positioned and configured so as to face an interior side surface of the well when the down hole unit is positioned at the predetermined depth within the interior cavity of the well, and drilling apparatus disposed in the passage through the down hole unit including within the elbow, the drilling apparatus being configured and operable for extending sidewardly from the lateral opening of the kick-off shoe for forming the lateral passage in the earth strata beside the well;

apparatus configured for carrying a pressurized fluid downwardly through the well and through the upper opening into the elbow of the kick-off shoe of the down hole unit, the elbow having a sectional extent larger than the drilling apparatus such that the pressurized fluid will flow through the elbow about the drilling apparatus toward the lateral opening, and the elbow being configured for discharging the pressurized fluid from the lateral opening into the interior cavity of the well and under a sufficient pressure for preventing particles generated by operation of the drilling apparatus discharged into the interior cavity of the well from entering the lateral opening; and a channel on a laterally facing external surface of the kick-off shoe including the lateral opening, extending away from the lateral opening and configured for guiding the pressurized fluid discharged therefrom and cuttings carried thereby, away from the lateral opening.

2. Apparatus of claim 1, wherein the drilling apparatus comprises a flexible tube extendable from the lateral opening and includes a nozzle configured for directing at least one stream of a fluid against the strata for forming the lateral passage therein.

3. Apparatus of claim 2, wherein the drilling apparatus comprises apparatus for rotating the nozzle.

4. Apparatus of claim 2, wherein the drilling apparatus comprises apparatus operable for moving the at least one stream of the fluid in a manner for forming the lateral passage to have a transverse extent at least marginally greater than a transverse extent of the flexible tube.

5. Apparatus of claim 1, wherein the apparatus configured for carrying the pressurized fluid downwardly through the well and into the down hole unit comprises the tubular element.

6. Apparatus of claim 5, further comprising a compressor connected in fluid communication with the internal passage through the tubular element and operable for pressurizing the pressurized fluid and directing the pressurized fluid downwardly through the internal passage, and wherein the pressurized fluid comprises a compressed gas or an emulsion.

7. Apparatus of claim 1, wherein the kick-off shoe is configured such that the pressurized fluid discharged from the lateral opening will flow upwardly through the well along an external surface of the kick-off shoe, and wherein the kick-off shoe additionally comprises an outlet located adjacent to the lateral opening and connected to the elbow, for discharging a flow of the pressurized fluid in a manner for boosting the upward flow of the fluid along the kick-off shoe.

8. Apparatus of claim 7, wherein the at least one outlet comprises an outlet located above the lateral opening.

9. Apparatus of claim 1, wherein the drilling apparatus comprises a conduit and a nozzle configured and operable for directing a flow of a pressurized liquid outwardly from the lateral passage toward the lateral opening of the kick-off shoe, for carrying cuttings out of the lateral passage and toward the lateral opening, and wherein the apparatus configured for carrying the pressurized fluid downwardly through the well and into the kick-off shoe, and the at least one outlet on the kick-off shoe, are configured for discharging the pressurized fluid at a pressure sufficient for directing the flow of pressurized liquid from the lateral passage and the cuttings carried thereby, upwardly from the lateral opening.

10. Apparatus of claim 1, wherein the drilling apparatus comprises a flexible element carrying a bit rotatable for cutting a hole in a casing of the well.

11. Apparatus of claim 1, wherein the tubular element comprises at least one orifice configured for discharging a portion of the pressurized fluid into the internal cavity of the well, for operating in cooperation with the pressurized fluid discharged from the kick-off shoe, for reducing a hydrostatic head in the well.

12. Apparatus of claim 11, comprising a plurality of the orifices located at spaced locations along the tubular element, respectively.

13. Apparatus for forming a lateral passage in earth strata beside a well, comprising:

a tubular element configured to extend downwardly within an interior cavity of the well, the tubular element including an internal passage therethrough;

a down hole unit connected to the tubular element so as to be supportable thereby at a predetermined depth within the interior cavity of the well, the down hole unit including a lowermost kick-off shoe and a passage extending therethrough between an upper opening connecting with the internal passage through the tubular element, and a sidewardly facing lateral opening on the kick-off shoe lower than the upper opening positioned and configured so as to face an interior side surface of the well when the down hole unit is positioned at the predetermined depth within the interior cavity of the well;

drilling apparatus disposed in the passage through the down hole unit and configured and operable for extending sidewardly from the lateral opening of the kick-off shoe for forming the lateral passage in the earth strata beside the well;

apparatus configured for carrying a pressurized fluid downwardly through the well and into the kick-off shoe of the down hole unit, and at least one outlet on the kick-off shoe configured for discharging the pressurized fluid from or in close proximity to the lateral opening into the interior cavity of the well and under a sufficient pressure for directing particles generated by operation of the drilling apparatus discharged into the interior cavity of the well away from the lateral opening; and a channel on a laterally facing external surface of the kick-off shoe including the lateral opening, extending away from the lateral opening and configured for guiding the pressurized fluid discharged therefrom and cuttings carried thereby, away from the lateral opening.

* * * * *